US011739965B2

(12) United States Patent
Friend

(10) Patent No.: US 11,739,965 B2
(45) Date of Patent: Aug. 29, 2023

(54) THERMOSTAT WITH SEGMENTED DISPLAY

(71) Applicant: Johnson Controls Technology Company, Auburn Hills, MI (US)

(72) Inventor: Richard David Friend, Levittown, PA (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 311 days.

(21) Appl. No.: 17/108,758

(22) Filed: Dec. 1, 2020

(65) Prior Publication Data

US 2021/0164679 A1 Jun. 3, 2021

Related U.S. Application Data

(60) Provisional application No. 62/942,632, filed on Dec. 2, 2019.

(51) Int. Cl.

| | |
|---|---|
| ***F24F 11/52*** | (2018.01) |
| ***G09G 3/04*** | (2006.01) |
| ***F24F 11/65*** | (2018.01) |
| ***F24F 11/54*** | (2018.01) |

(52) U.S. Cl.

CPC ..... *F24F 11/52* (2018.01); *F24F 11/54* (2018.01); *F24F 11/65* (2018.01); *G09G 3/04* (2013.01)

(58) Field of Classification Search

None

See application file for complete search history.

(56) References Cited

U.S. PATENT DOCUMENTS

| | | | | |
|---|---|---|---|---|
| 3,971,012 | A * | 7/1976 | Morokawa | G04G 9/085 968/956 |
| 4,184,319 | A * | 1/1980 | Kumata | G04G 9/087 368/29 |
| 4,194,352 | A * | 3/1980 | Terzian | G04G 9/08 368/239 |
| 5,323,143 | A * | 6/1994 | Naradate | G09G 3/04 345/99 |
| 9,897,977 | B2 * | 2/2018 | Klopfenstein | G09G 3/04 |

* cited by examiner

*Primary Examiner* — Nicholas J Lee

(74) *Attorney, Agent, or Firm* — Foley & Lardner LLP

(57) ABSTRACT

A control device for a building includes a segment display. The segment display includes a first character comprising at least seven segments, a second character comprising at least nine segments proximate to the first character, and a connecting character comprising at least two segments located between the first and second character. The control device further includes a processing circuit that, in a first operation, illuminates at least one segment of each of the first character, the second character, and the connecting character to form a first letter and, in a second operation, illuminates at least one segment of each of the first character, the second character, and the connecting character to form a second letter.

20 Claims, 19 Drawing Sheets

Advanced Settings

THERMOSTAT WITH SEGMENTED DISPLAY

CROSS-REFERENCE TO RELATED PATENT APPLICATION

This application claims priority from U.S. Provisional Application No. 62/942,632, filed Dec. 2, 2019, incorporated herein by reference in its entirety.

BACKGROUND

Heating, ventilating, or air conditioning (HVAC) systems for residential buildings typically include a controller, such as a thermostat, installed within the building to monitor temperature and provide control signals to HVAC equipment. The thermostats may display information to a user on a user interface, or display, from the thermostat. The display may be provided wirelessly or is provided directly on the thermostat. The information on the display may be provided in a segmented-display format, wherein certain characters on the display may be illuminated by providing electrical signals to certain segments of the characters.

Typical segmented displays include seven segment display packages that are inexpensive and simple to install. However, illumination of the character is limited to only seven segments. There exists a need to generate more detailed and accurate characters for a thermostat display.

SUMMARY

One implementation of the present disclosure is a control device for a building. The control device includes a segment display. The segment display includes a first character including at least seven segments. The segment display further includes a second character including at least nine segments proximate to the first character. The segment display further includes a connecting character including at least two segments located between the first character and the second character. The control device further includes a processing circuit configured to, in a first operation, illuminate at least one segment of each of the first character, the second character, and the connecting character to form a first letter. The processing circuit is further configured to, in a second operation, illuminate at least one segment of each of the first character, the second character, and the connecting character to form a second letter.

In some embodiments, the control device is a thermostat. In some embodiments, illuminating at least one segment of each of the first character, the second character, and the connecting character to form the first letter further includes illuminating the letter "M."

In some embodiments, illuminating at least one segment of each of the first character, the second character, and the connecting character to form the second letter further includes illuminating the letter "W."

In some embodiments, illuminating at least one segment of each of the first character, the second character, and the connecting character to form the first letter further includes illuminating a top segment of the first character, illuminating a top segment of the second character, illuminating a top segment of the connecting character, and illuminating a right segment on the first character or a left segment on the second character.

In some embodiments, illuminating at least one segment of each of the first character, the second character, and the connecting character to form the second letter further includes illuminating a bottom segment of the first character, illuminating a bottom segment of the second character, illuminating a top segment of the connecting character, and illuminating a right segment on the first character or a left segment on the second character.

In some embodiments, the processing circuit is further configured to receive an error signal indicative of an error within the control device and illuminate a plurality of characters to display an error message on the segment display. In some embodiments, at least one of the plurality of characters includes at least nine segments. In some embodiments, the error message comprises at least one letter "R."

In some embodiments, the connecting character including at least two segments located between the first character and the second character further includes a first dot segment located above the bottom of the connecting character and a second dot segment located below the top of the connecting character. In some embodiments, illuminating the first dot segment and the second dot segment illuminates a colon symbol on a display of the device.

Another implementation of the present disclosure is a method for displaying information on a control device. The method includes displaying, via a segment display, a first character comprising at least seven segments. The method further includes displaying, via the segment display, a second character comprising at least nine segments proximate to the first character. The method further includes displaying, via the segment display, a connecting character comprising at least two segments located between the first character and the second character. The method further includes illuminating at least one segment of each of the first character, the second character, and the connecting character to form a first letter. The method further includes illuminating at least one segment of each of the first character, the second character, and the connecting character to form a second letter.

In some embodiments, illuminating at least one segment of each of the first character, the second character, and the connecting character to form the first letter further includes illuminating the letter "M."

In some embodiments, illuminating at least one segment of each of the first character, the second character, and the connecting character to form the second letter further includes illuminating the letter "W."

In some embodiments, illuminating at least one segment of each of the first character, the second character, and the connecting character to form the first letter further includes illuminating a top segment of the first character, illuminating a top segment of the second character, illuminating a top segment of the connecting character, and illuminating a right segment on the first character or a left segment on the second character.

In some embodiments, illuminating at least one segment of each of the first character, the second character, and the connecting character to form the second letter further includes illuminating a bottom segment of the first character, illuminating a bottom segment of the second character, illuminating a top segment of the connecting character, and illuminating a right segment on the first character or a left segment on the second character.

In some embodiments, the method further includes receiving an error signal indicative of an error within the control device and illuminating a plurality of characters to display an error message on the segment display. In some embodiments, at least one of the plurality of characters includes at least nine segments. In some embodiments, the error message comprises at least one letter "R."

In some embodiments, the connecting character comprising at least two segments located between the first character and the second character further includes a first dot segment located above the bottom of the connecting character and a second dot segment located below the top of the connecting character, wherein illuminating the first dot segment and the second dot segment illuminates a colon symbol on a display of the device.

Another implementation of the present disclosure is a control device for controlling HVAC equipment. The control device includes a processing circuit configured to provide a control signal to HVAC equipment in response to a temperature sensed by a temperature sensor. The control device further includes a housing including a base, a first removable insert configured to selectively attach to the base, wherein the first removable insert includes a first set of brand identification information that is visible to a user when the first removable insert is attached to the base, a second removable insert configured to selectively attach to the base, wherein the second removable insert includes a second set of brand identification information that is visible to the user when the second removable insert is attached to the base.

In some embodiments, first removable insert and the second removable insert may not both be selectively attached to the base at the same time.

In some embodiments, the first removable insert and the second removable insert are selectively attached to the base by means of a snap-fit connection.

In some embodiments, the control device further includes selective locking mechanisms to provide locking capabilities for the first removable insert and the second removable insert and reject locking capabilities of other inserts.

In some embodiments, the first set of brand identification information further includes a first set of a name, trademark, or logo of a company that installs the control device, and the second set of brand identification information includes a second set of a name, trademark, or logo of a company that installs the control device.

In some embodiments, the base is located on a lower portion, a side portion, a back portion of the control device.

DETAILED DESCRIPTION

Overview

Referring generally to the FIGURES, a thermostat with segmented display in a heating, ventilation, or air conditioning system is shown. The display includes one or more segmented display packages that, when provided electrical signals, illuminate segments of a character to display a portion of a character on the display. The packages may include various segments per package, such as seven segments, nine segments, fourteen segments, or more. The display may also include a connecting character that connects a two or more characters together.

The combination and/or orientation in how the characters are located, as well as the number of segments within the segment package, may affect the detail and accuracy of the display. Incorporating a character with more than seven segments proximate to a character with seven segments, and illuminating the segments from the character with more than seven segments, may allow for more detailed characters that were otherwise unable to be illuminated, such as the letter "M," the letter "W," or the colon.

System Overview

Building HVAC System

Figure 1:
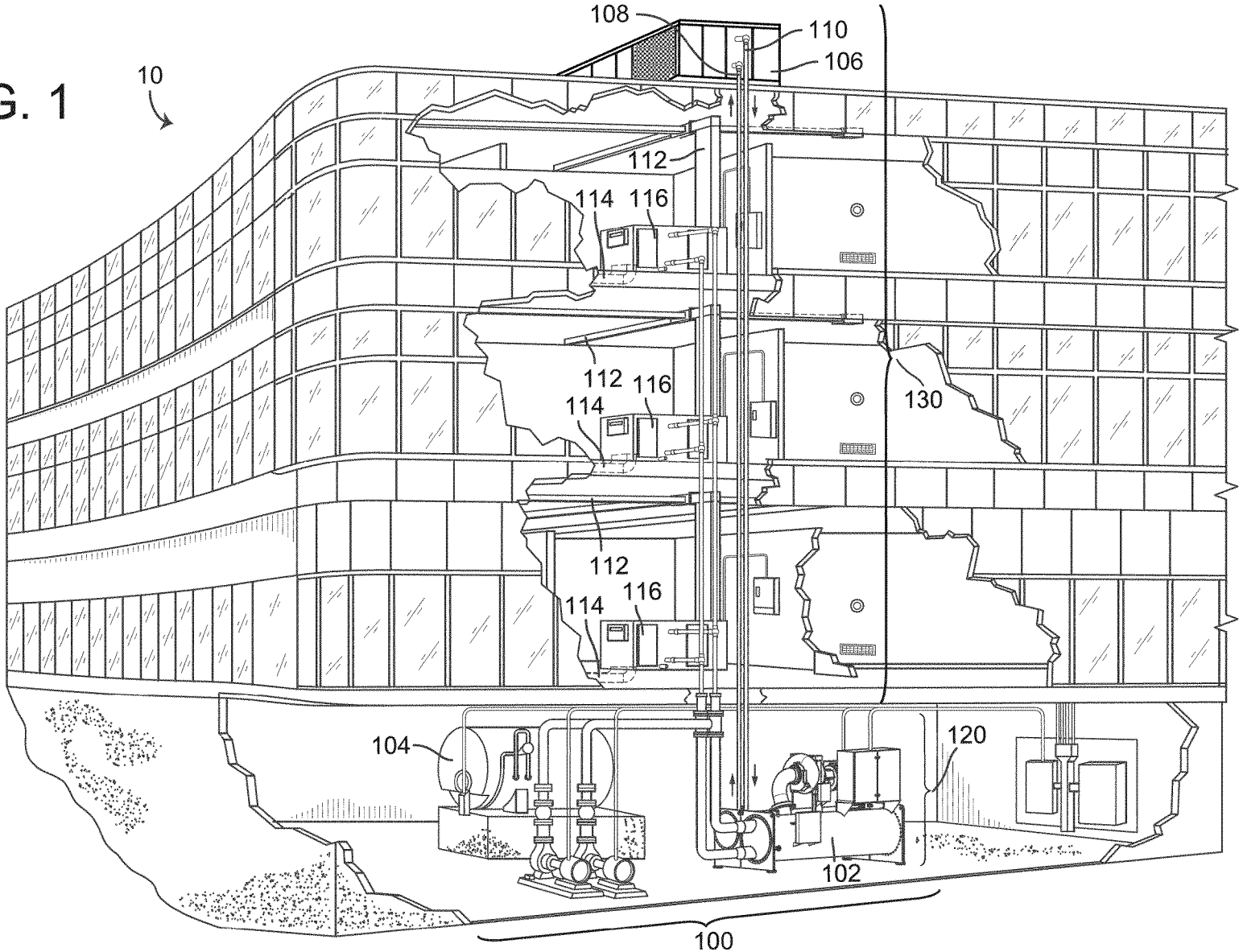
FIG. 1 is a drawing of a building equipped with a heating, ventilation, or air conditioning (HVAC) system, according to an exemplary embodiment.

Referring now to FIG. 1, a perspective view of a building 10 is shown. Building 10 is served by a building management system (BMS). A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof.

The BMS that serves building 10 includes an HVAC system 100. HVAC system 100 may include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 may provide a heated or chilled fluid to an air handling unit of airside system 130. Airside system 130 may use the heated or chilled fluid to heat or cool an airflow provided to building 10. In some embodiments, waterside system 120 is replaced with a central energy plant such as central plant 200, described with reference to FIG. 2.

Still referring to FIG. 1, HVAC system 100 is shown to include a chiller 102, a boiler 104, and a rooftop air handling unit (AHU) 106. Waterside system 120 may use boiler 104 and chiller 102 to heat or cool a working fluid (e.g., water, glycol, etc.) and may circulate the working fluid to AHU 106. In various embodiments, the HVAC devices of waterside system 120 may be located in or around building 10 (as shown in FIG. 1) or at an offsite location such as a central plant (e.g., a chiller plant, a steam plant, a heat plant, etc.). The working fluid may be heated in boiler 104 or cooled in chiller 102, depending on whether heating or cooling is required in building 10. Boiler 104 may add heat to the circulated fluid, for example, by burning a combustible material (e.g., natural gas) or using an electric heating element. Chiller 102 may place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 may be transported to AHU 106 via piping 108.

AHU 106 may place the working fluid in a heat exchange relationship with an airflow passing through AHU 106 (e.g., via one or more stages of cooling coils and/or heating coils). The airflow may be, for example, outside air, return air from within building 10, or a combination of both. AHU 106 may transfer heat between the airflow and the working fluid to provide heating or cooling for the airflow. For example, AHU 106 may include one or more fans or blowers configured to pass the airflow over or through a heat exchanger containing the working fluid. The working fluid may then return to chiller 102 or boiler 104 via piping 110.

Airside system 130 may deliver the airflow supplied by AHU 106 (i.e., the supply airflow) to building 10 via air supply ducts 112 and may provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 may include dampers or other flow control elements that can be operated to control an amount of the supply airflow provided to individual zones of building 10. In other embodiments, airside system 130 delivers the supply airflow into one or more zones of building 10 (e.g., via air supply ducts 112) without using intermediate VAV units 116 or other flow control elements. AHU 106 may include various sensors (e.g., temperature sensors, pressure sensors, etc.) configured to measure attributes of the supply airflow. AHU 106 may receive input from sensors located within AHU 106 and/or within the building zone and may adjust the flow rate, temperature, or other attributes of the supply airflow through AHU 106 to achieve setpoint conditions for the building zone.

Figure 2:
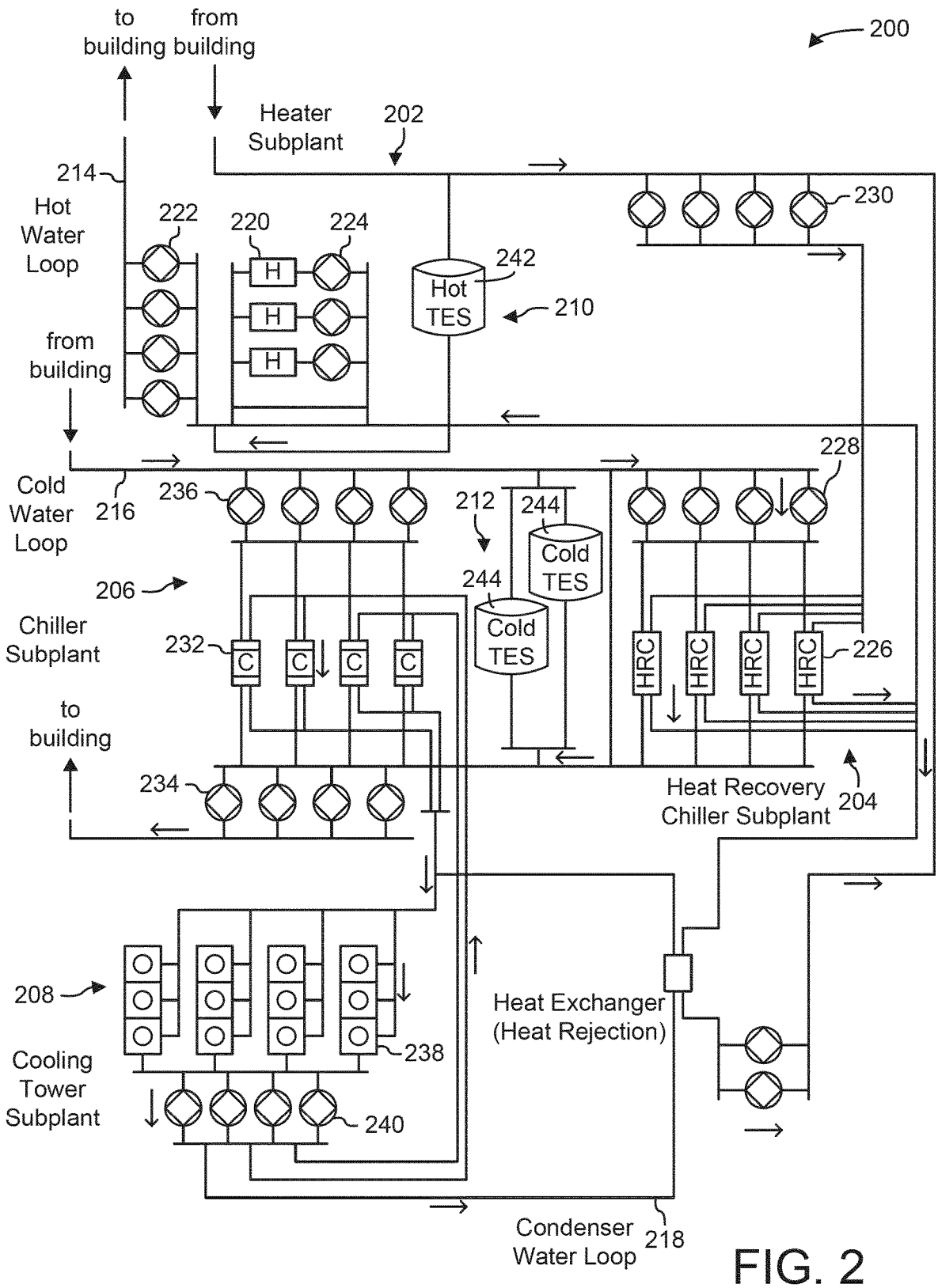
FIG. 2 is a schematic of a waterside system which can be used as part of the HVAC system of FIG. 1, according to some embodiments.

Referring now to FIG. 2, a block diagram of a central plant 200 is shown, according to an exemplary embodiment. In brief overview, central plant 200 may include various types of equipment configured to serve the thermal energy loads of a building or campus (i.e., a system of buildings). For example, central plant 200 may include heaters, chillers, heat recovery chillers, cooling towers, or other types of equipment configured to serve the heating and/or cooling loads of a building or campus. Central plant 200 may consume resources from a utility (e.g., electricity, water, natural gas, etc.) to heat or cool a working fluid that is circulated to one or more buildings or stored for later use (e.g., in thermal energy storage tanks) to provide heating or cooling for the buildings. In various embodiments, central plant 200 may supplement or replace waterside system 120 in building 10 or may be implemented separate from building 10 (e.g., at an offsite location).

Central plant 200 is shown to include a plurality of subplants 202-212 including a heater subplant 202, a heat recovery chiller subplant 204, a chiller subplant 206, a cooling tower subplant 208, a hot thermal energy storage (TES) subplant 210, and a cold thermal energy storage (TES) subplant 212. Subplants 202-212 consume resources from utilities to serve the thermal energy loads (e.g., hot water, cold water, heating, cooling, etc.) of a building or campus. For example, heater subplant 202 may be configured to heat water in a hot water loop 214 that circulates the hot water between heater subplant 202 and building 10. Chiller subplant 206 may be configured to chill water in a cold water loop 216 that circulates the cold water between chiller subplant 206 and building 10. Heat recovery chiller subplant 204 may be configured to transfer heat from cold water loop 216 to hot water loop 214 to provide additional heating for the hot water and additional cooling for the cold water. Condenser water loop 218 may absorb heat from the cold water in chiller subplant 206 and reject the absorbed heat in cooling tower subplant 208 or transfer the absorbed heat to hot water loop 214. Hot TES subplant 210 and cold TES subplant 212 may store hot and cold thermal energy, respectively, for subsequent use.

Hot water loop 214 and cold water loop 216 may deliver the heated and/or chilled water to air handlers located on the rooftop of building 10 (e.g., AHU 106) or to individual floors or zones of building 10 (e.g., VAV units 116). The air handlers push air past heat exchangers (e.g., heating coils or cooling coils) through which the water flows to provide heating or cooling for the air. The heated or cooled air may be delivered to individual zones of building 10 to serve the thermal energy loads of building 10. The water then returns to subplants 202-212 to receive further heating or cooling.

Although subplants 202-212 are shown and described as heating and cooling water for circulation to a building, it is understood that any other type of working fluid (e.g., glycol, $CO_2$, etc.) may be used in place of or in addition to water to serve the thermal energy loads. In other embodiments, subplants 202-212 may provide heating and/or cooling directly to the building or campus without requiring an intermediate heat transfer fluid. These and other variations to central plant 200 are within the teachings of the present invention.

Each of subplants 202-212 may include a variety of equipment configured to facilitate the functions of the subplant. For example, heater subplant 202 is shown to include a plurality of heating elements 220 (e.g., boilers, electric heaters, etc.) configured to add heat to the hot water in hot water loop 214. Heater subplant 202 is also shown to include several pumps 222 and 224 configured to circulate the hot water in hot water loop 214 and to control the flow rate of the hot water through individual heating elements 220. Chiller subplant 206 is shown to include a plurality of chillers 232 configured to remove heat from the cold water in cold water loop 216. Chiller subplant 206 is also shown to include several pumps 234 and 236 configured to circulate the cold water in cold water loop 216 and to control the flow rate of the cold water through individual chillers 232.

Heat recovery chiller subplant 204 is shown to include a plurality of heat recovery heat exchangers 226 (e.g., refrigeration circuits) configured to transfer heat from cold water loop 216 to hot water loop 214. Heat recovery chiller subplant 204 is also shown to include several pumps 228 and 230 configured to circulate the hot water and/or cold water through heat recovery heat exchangers 226 and to control the flow rate of the water through individual heat recovery heat exchangers 226. Cooling tower subplant 208 is shown to include a plurality of cooling towers 238 configured to remove heat from the condenser water in condenser water loop 218. Cooling tower subplant 208 is also shown to include several pumps 240 configured to circulate the condenser water in condenser water loop 218 and to control the flow rate of the condenser water through individual cooling towers 238.

Hot TES subplant 210 is shown to include a hot TES tank 242 configured to store the hot water for later use. Hot TES subplant 210 may also include one or more pumps or valves configured to control the flow rate of the hot water into or out of hot TES tank 242. Cold TES subplant 212 is shown to include cold TES tanks 244 configured to store the cold water for later use. Cold TES subplant 212 may also include one or more pumps or valves configured to control the flow rate of the cold water into or out of cold TES tanks 244.

In some embodiments, one or more of the pumps in central plant 200 (e.g., pumps 222, 224, 228, 230, 234, 236, and/or 240) or pipelines in central plant 200 include an isolation valve associated therewith. Isolation valves may be integrated with the pumps or positioned upstream or downstream of the pumps to control the fluid flows in central plant 200. In various embodiments, central plant 200 may include more, fewer, or different types of devices and/or subplants based on the particular configuration of central plant 200 and the types of loads served by central plant 200.

Figure 3:
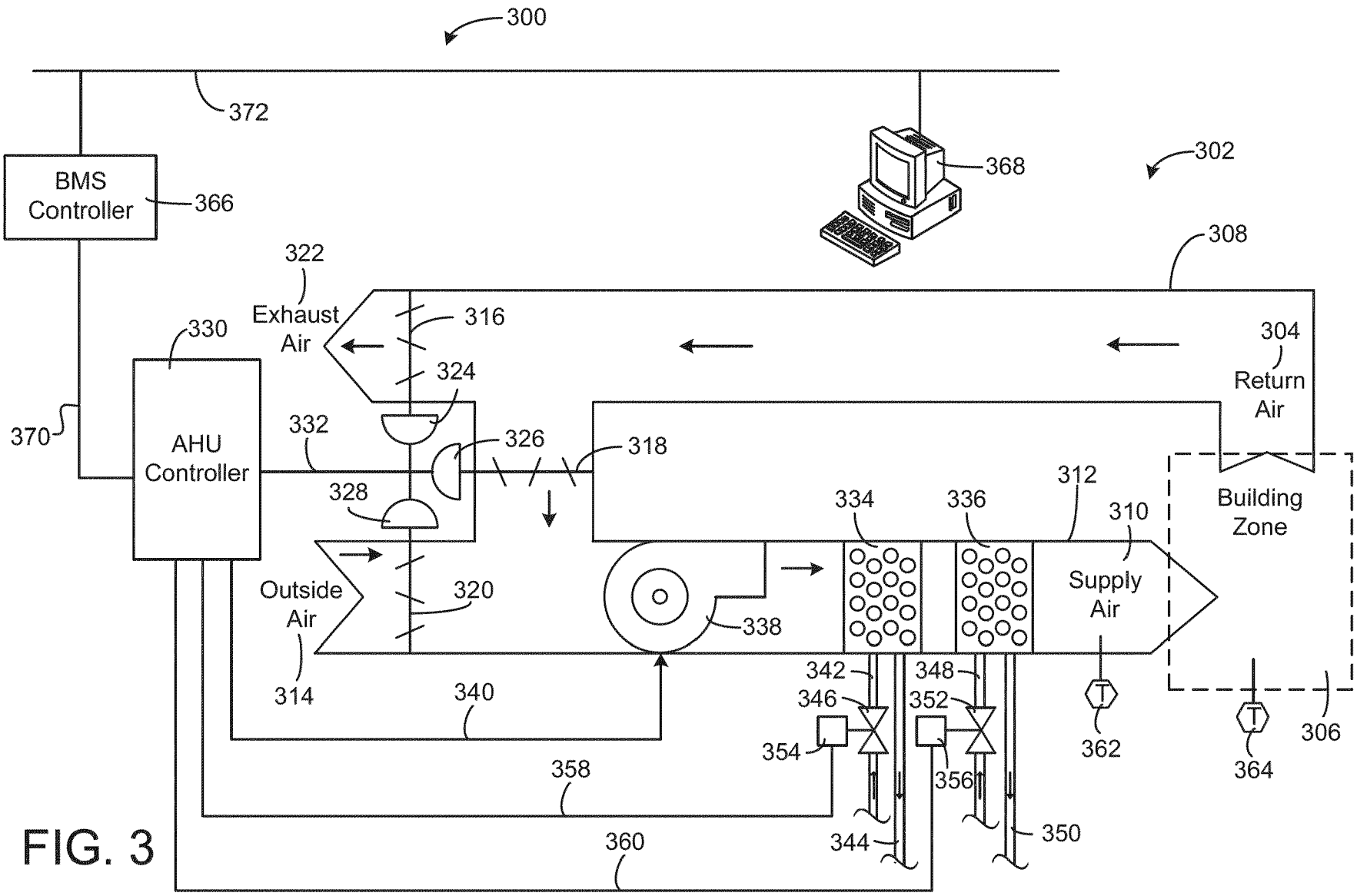
FIG. 3 is a block diagram of an airside system which can be used as part of the HVAC system of FIG. 1, according to some embodiments.

Referring now to FIG. 3, a block diagram of an airside system 300 is shown, according to an example embodiment. In various embodiments, airside system 300 can supplement or replace airside system 130 in HVAC system 100 or can be implemented separate from HVAC system 100. When implemented in HVAC system 100, airside system 300 can include a subset of the HVAC devices in HVAC system 100 (e.g., AHU 106, VAV units 116, duct 112, duct 114, fans, dampers, etc.) and can be located in or around building 10. Airside system 300 can operate to heat or cool an airflow provided to building 10 using a heated or chilled fluid provided by waterside system 200.

In FIG. 3, airside system 300 is shown to include an economizer-type air handling unit (AHU) 302. Economizer-type AHUs vary the amount of outside air and return air used by the air handling unit for heating or cooling. For example, AHU 302 can receive return air 304 from building zone 306 via return air duct 308 and can deliver supply air 310 to building zone 306 via supply air duct 312. In some embodiments, AHU 302 is a rooftop unit located on the roof of building 10 (e.g., AHU 106 as shown in FIG. 1) or otherwise positioned to receive both return air 304 and outside air 314. AHU 302 can be configured to operate exhaust air damper 316, mixing damper 318, and outside air damper 320 to control an amount of outside air 314 and return air 304 that combine to form supply air 310. Any return air 304 that does not pass through mixing damper 318 can be exhausted from AHU 302 through exhaust damper 316 as exhaust air 322.

Each of dampers 316-320 can be operated by an actuator. For example, exhaust air damper 316 can be operated by actuator 324, mixing damper 318 can be operated by actuator 326, and outside air damper 320 can be operated by actuator 328. Actuators 324-328 can communicate with an AHU controller 330 via a communications link 332. Actuators 324-328 can receive control signals from AHU controller 330 and can provide feedback signals to AHU controller 330. Feedback signals can include, for example, an indication of a current actuator or damper position, an amount of torque or force exerted by the actuator, diagnostic information (e.g., results of diagnostic tests performed by actuators 324-328), status information, commissioning information, configuration settings, calibration data, and/or other types of information or data that can be collected, stored, or used by actuators 324-328. AHU controller 330 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 324-328.

Still referring to FIG. 3, AHU 302 is shown to include a cooling coil 334, a heating coil 336, and a fan 338 positioned within supply air duct 312. Fan 338 can be configured to force supply air 310 through cooling coil 334 and/or heating coil 336 and provide supply air 310 to building zone 306. AHU controller 330 can communicate with fan 338 via communications link 340 to control a flow rate of supply air 310. In some embodiments, AHU controller 330 controls an amount of heating or cooling applied to supply air 310 by modulating a speed of fan 338.

Cooling coil 334 can receive a chilled fluid from waterside system 200 (e.g., from cold water loop 216) via piping 342 and can return the chilled fluid to waterside system 200 via piping 344. Valve 346 can be positioned along piping 342 or piping 344 to control a flow rate of the chilled fluid through cooling coil 334. In some embodiments, cooling coil 334 includes multiple stages of cooling coils that can be independently activated and deactivated (e.g., by AHU controller 330, by BMS controller 366, etc.) to modulate an amount of cooling applied to supply air 310.

Heating coil 336 can receive a heated fluid from waterside system 200 (e.g., from hot water loop 214) via piping 348 and can return the heated fluid to waterside system 200 via piping 350. Valve 352 can be positioned along piping 348 or piping 350 to control a flow rate of the heated fluid through heating coil 336. In some embodiments, heating coil 336 includes multiple stages of heating coils that can be independently activated and deactivated (e.g., by AHU controller 330, by BMS controller 366, etc.) to modulate an amount of heating applied to supply air 310.

Each of valves 346 and 352 can be controlled by an actuator. For example, valve 346 can be controlled by actuator 354 and valve 352 can be controlled by actuator 356. Actuators 354-356 can communicate with AHU controller 330 via communications links 358-360. Actuators 354-356 can receive control signals from AHU controller 330 and can provide feedback signals to controller 330. In some embodiments, AHU controller 330 receives a measurement of the supply air temperature from a temperature sensor 362 positioned in supply air duct 312 (e.g., downstream of cooling coil 334 and/or heating coil 336). AHU controller 330 can also receive a measurement of the temperature of building zone 306 from a temperature sensor 364 located in building zone 306.

In some embodiments, AHU controller 330 operates valves 346 and 352 via actuators 354-356 to modulate an amount of heating or cooling provided to supply air 310 (e.g., to achieve a setpoint temperature for supply air 310 or to maintain the temperature of supply air 310 within a setpoint temperature range). The positions of valves 346 and 352 affect the amount of heating or cooling provided to supply air 310 by cooling coil 334 or heating coil 336 and may correlate with the amount of energy consumed to achieve a desired supply air temperature. AHU controller 330 can control the temperature of supply air 310 and/or building zone 306 by activating or deactivating coils 334-336, adjusting a speed of fan 338, or a combination of both.

Still referring to FIG. 3, airside system 300 is shown to include a building management system (BMS) controller 366 and a client device 368. BMS controller 366 can include one or more computer systems (e.g., servers, supervisory controllers, subsystem controllers, etc.) that serve as system level controllers, application or data servers, head nodes, or master controllers for airside system 300, waterside system 200, HVAC system 100, and/or other controllable systems that serve building 10. BMS controller 366 can communicate with multiple downstream building systems or subsystems (e.g., HVAC system 100, a security system, a lighting system, waterside system 200, etc.) via a communications link 370 according to like or disparate protocols (e.g., LON, BACnet, etc.). In various embodiments, AHU controller 330 and BMS controller 366 can be separate (as shown in FIG. 3) or integrated. In an integrated implementation, AHU controller 330 can be a software module configured for execution by a processor of BMS controller 366.

In some embodiments, AHU controller 330 receives information from BMS controller 366 (e.g., commands, setpoints, operating boundaries, etc.) and provides information to BMS controller 366 (e.g., temperature measurements, valve or actuator positions, operating statuses, diagnostics, etc.). For example, AHU controller 330 can provide BMS controller 366 with temperature measurements from temperature sensors 362 and 364, equipment on/off states, equipment operating capacities, and/or any other information that can be used by BMS controller 366 to monitor or control a variable state or condition within building zone 306.

Client device 368 can include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, its subsystems, and/or devices. Client device 368 can be a computer workstation, a client terminal, a remote or local interface, or any other type of user interface device. Client device 368 can be a stationary terminal or a mobile device. For example, client device 368 can be a desktop computer, a computer server with a user interface, a laptop computer, a tablet, a smartphone, a PDA, or any other type of mobile or non-mobile device. Client device 368 can communicate with BMS controller 366 and/or AHU controller 330 via communications link 372.

Figure 4:
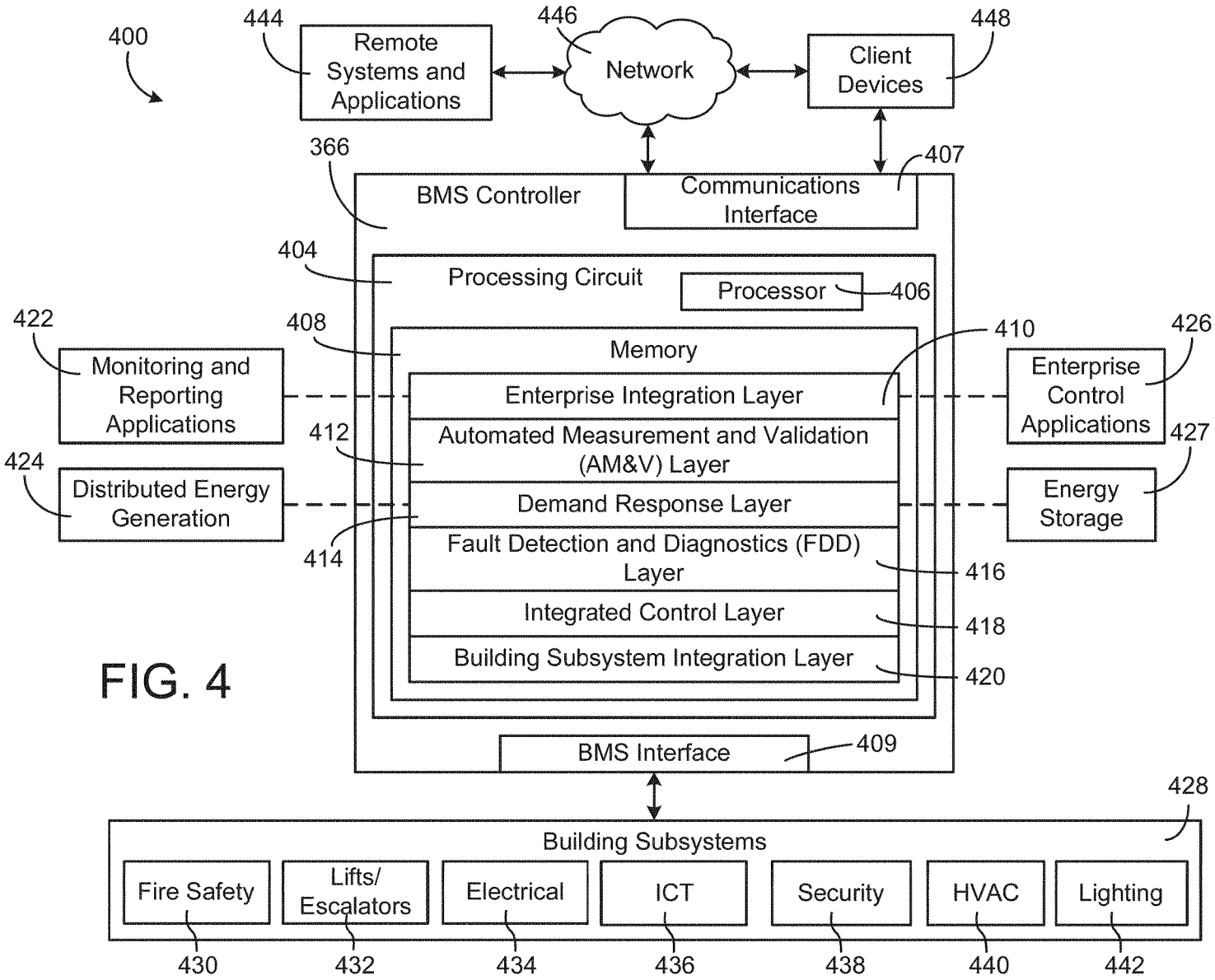
FIG. 4 is a block diagram of a building management system (BMS) which can be used in the building of FIG. 1, according to some embodiments.

Referring now to FIG. 4, a block diagram of a building management system (BMS) 400 is shown, according to an example embodiment. BMS 400 can be implemented in building 10 to automatically monitor and control various building functions. BMS 400 is shown to include BMS controller 366 and a plurality of building subsystems 428. Building subsystems 428 are shown to include a building electrical subsystem 434, an information communication technology (ICT) subsystem 436, a security subsystem 438, a HVAC subsystem 440, a lighting subsystem 442, a lift/escalators subsystem 432, and a fire safety subsystem 430. In various embodiments, building subsystems 428 can include fewer, additional, or alternative subsystems. For example, building subsystems 428 can also or alternatively include a refrigeration subsystem, an advertising or signage subsystem, a cooking subsystem, a vending subsystem, a printer or copy service subsystem, or any other type of building subsystem that uses controllable equipment and/or sensors to monitor or control building 10. In some embodiments, building subsystems 428 include waterside system 200 and/or airside system 300, as described with reference to FIGS. 2 and 3.

Each of building subsystems 428 can include any number of devices, controllers, and connections for completing its individual functions and control activities. HVAC subsystem 440 can include many of the same components as HVAC system 100, as described with reference to FIGS. 1-3. For example, HVAC subsystem 440 can include a chiller, a boiler, any number of air handling units, economizers, field controllers, supervisory controllers, actuators, temperature sensors, and other devices for controlling the temperature, humidity, airflow, or other variable conditions within building 10. Lighting subsystem 442 can include any number of light fixtures, ballasts, lighting sensors, dimmers, or other devices configured to controllably adjust the amount of light provided to a building space. Security subsystem 438 can include occupancy sensors, video surveillance cameras, digital video recorders, video processing servers, intrusion detection devices, access control devices (e.g., card access, etc.) and servers, or other security-related devices.

Still referring to FIG. 4, BMS controller 366 is shown to include a communications interface 407 and a BMS interface 409. Interface 407 can facilitate communications between BMS controller 366 and external applications (e.g., monitoring and reporting applications 422, enterprise control applications 426, remote systems and applications 444, applications residing on client devices 448, etc.) for allowing user control, monitoring, and adjustment to BMS controller 366 and/or subsystems 428. Interface 407 can also facilitate communications between BMS controller 366 and client devices 448. BMS interface 409 can facilitate communications between BMS controller 366 and building subsystems 428 (e.g., HVAC, lighting security, lifts, power distribution, business, etc.).

Interfaces 407, 409 can be or include wired or wireless communications interfaces (e.g., jacks, antennas, transmitters, receivers, transceivers, wire terminals, etc.) for conducting data communications with building subsystems 428 or other external systems or devices. In various embodiments, communications via interfaces 407, 409 can be direct (e.g., local wired or wireless communications) or via a communications network 446 (e.g., a WAN, the Internet, a cellular network, etc.). For example, interfaces 407, 409 can include an Ethernet card and port for sending and receiving data via an Ethernet-based communications link or network. In another example, interfaces 407, 409 can include a Wi-Fi transceiver for communicating via a wireless communications network. In another example, one or both of interfaces 407, 409 can include cellular or mobile phone communications transceivers. In one embodiment, communications interface 407 is a power line communications interface and BMS interface 409 is an Ethernet interface. In other embodiments, both communications interface 407 and BMS interface 409 are Ethernet interfaces or are the same Ethernet interface.

Still referring to FIG. 4, BMS controller 366 is shown to include a processing circuit 404 including a processor 406 and memory 408. Processing circuit 404 can be communicably connected to BMS interface 409 and/or communications interface 407 such that processing circuit 404 and the various components thereof can send and receive data via interfaces 407, 409. Processor 406 can be implemented as a general purpose processor, an application specific integrated circuit (ASIC), one or more field programmable gate arrays (FPGAs), a group of processing components, or other suitable electronic processing components.

Memory 408 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. Memory 408 can be or include volatile memory or non-volatile memory. Memory 408 can include database components, object code components, script components, or any other type of information structure for supporting the various activities and information structures described in the present application. According to an example embodiment, memory 408 is communicably connected to processor 406 via processing circuit 404 and includes computer code for executing (e.g., by processing circuit 404 and/or processor 406) one or more processes described herein.

In some embodiments, BMS controller 366 is implemented within a single computer (e.g., one server, one housing, etc.). In various other embodiments BMS controller 366 can be distributed across multiple servers or computers (e.g., that can exist in distributed locations). Further, while FIG. 4 shows applications 422 and 426 as existing outside of BMS controller 366, in some embodiments, applications 422 and 426 can be hosted within BMS controller 366 (e.g., within memory 408).

Still referring to FIG. 4, memory 408 is shown to include an enterprise integration layer 410, an automated measurement and validation (AM&V) layer 412, a demand response (DR) layer 414, a fault detection and diagnostics (FDD) layer 416, an integrated control layer 418, and a building subsystem integration later 420. Layers 410-420 can be configured to receive inputs from building subsystems 428 and other data sources, determine optimal control actions for building subsystems 428 based on the inputs, generate control signals based on the optimal control actions, and provide the generated control signals to building subsystems 428. The following paragraphs describe some of the general functions performed by each of layers 410-420 in BMS 400.

Enterprise integration layer 410 can be configured to serve clients or local applications with information and services to support a variety of enterprise-level applications. For example, enterprise control applications 426 can be configured to provide subsystem-spanning control to a graphical user interface (GUI) or to any number of enterprise-level business applications (e.g., accounting systems, user identification systems, etc.). Enterprise control applications 426 can also or alternatively be configured to provide configuration GUIs for configuring BMS controller 366. In yet other embodiments, enterprise control applications 426 can work with layers 410-420 to optimize building performance (e.g., efficiency, energy use, comfort, or safety) based on inputs received at interface 407 and/or BMS interface 409.

Building subsystem integration layer 420 can be configured to manage communications between BMS controller 366 and building subsystems 428. For example, building subsystem integration layer 420 can receive sensor data and input signals from building subsystems 428 and provide output data and control signals to building subsystems 428. Building subsystem integration layer 420 can also be configured to manage communications between building subsystems 428. Building subsystem integration layer 420 translate communications (e.g., sensor data, input signals, output signals, etc.) across a plurality of multi-vendor/multi-protocol systems.

Demand response layer 414 can be configured to optimize resource usage (e.g., electricity use, natural gas use, water use, etc.) and/or the monetary cost of such resource usage in response to satisfy the demand of building 10. The optimization can be based on time-of-use prices, curtailment signals, energy availability, or other data received from utility providers, distributed energy generation systems 424, from energy storage 427 (e.g., hot TES 242, cold TES 244, etc.), or from other sources. Demand response layer 414 can receive inputs from other layers of BMS controller 366 (e.g., building subsystem integration layer 420, integrated control layer 418, etc.). The inputs received from other layers can include environmental or sensor inputs such as temperature, carbon dioxide levels, relative humidity levels, air quality sensor outputs, occupancy sensor outputs, room schedules, and the like. The inputs can also include inputs such as electrical use (e.g., expressed in kWh), thermal load measurements, pricing information, projected pricing, smoothed pricing, curtailment signals from utilities, and the like.

According to an example embodiment, demand response layer 414 includes control logic for responding to the data and signals it receives. These responses can include communicating with the control algorithms in integrated control layer 418, changing control strategies, changing setpoints, or activating/deactivating building equipment or subsystems in a controlled manner. Demand response layer 414 can also include control logic configured to determine when to utilize stored energy. For example, demand response layer 414 can determine to begin using energy from energy storage 427 just prior to the beginning of a peak use hour.

In some embodiments, demand response layer 414 includes a control module configured to actively initiate control actions (e.g., automatically changing setpoints) which minimize energy costs based on one or more inputs representative of or based on demand (e.g., price, a curtailment signal, a demand level, etc.). In some embodiments, demand response layer 414 uses equipment models to determine an optimal set of control actions. The equipment models can include, for example, thermodynamic models describing the inputs, outputs, and/or functions performed by various sets of building equipment. Equipment models can represent collections of building equipment (e.g., subplants, chiller arrays, etc.) or individual devices (e.g., individual chillers, heaters, pumps, etc.).

Demand response layer 414 can further include or draw upon one or more demand response policy definitions (e.g., databases, XML, files, etc.). The policy definitions can be edited or adjusted by a user (e.g., via a graphical user interface) so that the control actions initiated in response to demand inputs can be tailored for the user's application, desired comfort level, particular building equipment, or based on other concerns. For example, the demand response policy definitions can specify which equipment can be turned on or off in response to particular demand inputs, how long a system or piece of equipment should be turned off, what setpoints can be changed, what the allowable set point adjustment range is, how long to hold a high demand setpoint before returning to a normally scheduled setpoint, how close to approach capacity limits, which equipment modes to utilize, the energy transfer rates (e.g., the maximum rate, an alarm rate, other rate boundary information, etc.) into and out of energy storage devices (e.g., thermal storage tanks, battery banks, etc.), and when to dispatch on-site generation of energy (e.g., via fuel cells, a motor generator set, etc.).

Integrated control layer 418 can be configured to use the data input or output of building subsystem integration layer 420 and/or demand response later 414 to make control decisions. Due to the subsystem integration provided by building subsystem integration layer 420, integrated control layer 418 can integrate control activities of the subsystems 428 such that the subsystems 428 behave as a single integrated supersystem. In an example embodiment, integrated control layer 418 includes control logic that uses inputs and outputs from a plurality of building subsystems to provide greater comfort and energy savings relative to the comfort and energy savings that separate subsystems could provide alone. For example, integrated control layer 418 can be configured to use an input from a first subsystem to make an energy-saving control decision for a second subsystem. Results of these decisions can be communicated back to building subsystem integration layer 420.

Integrated control layer 418 is shown to be logically below demand response layer 414. Integrated control layer 418 can be configured to enhance the effectiveness of demand response layer 414 by enabling building subsystems 428 and their respective control loops to be controlled in coordination with demand response layer 414. This configuration may advantageously reduce disruptive demand response behavior relative to conventional systems. For example, integrated control layer 418 can be configured to assure that a demand response-driven upward adjustment to the setpoint for chilled water temperature (or another component that directly or indirectly affects temperature) does not result in an increase in fan energy (or other energy used to cool a space) that would result in greater total building energy use than was saved at the chiller.

Integrated control layer 418 can be configured to provide feedback to demand response layer 414 so that demand response layer 414 checks that constraints (e.g., temperature, lighting levels, etc.) are properly maintained even while demanded load shedding is in progress. The constraints can also include setpoint or sensed boundaries relating to safety, equipment operating limits and performance, comfort, fire codes, electrical codes, energy codes, and the like. Integrated control layer 418 is also logically below fault detection and diagnostics layer 416 and automated measurement and validation layer 412. Integrated control layer 418 can be configured to provide calculated inputs (e.g., aggregations) to these higher levels based on outputs from more than one building subsystem.

Automated measurement and validation (AM&V) layer 412 can be configured to verify that control strategies commanded by integrated control layer 418 or demand response layer 414 are working properly (e.g., using data aggregated by AM&V layer 412, integrated control layer 418, building subsystem integration layer 420, FDD layer 416, or otherwise). The calculations made by AM&V layer 412 can be based on building system energy models and/or equipment models for individual BMS devices or subsystems. For example, AM&V layer 412 can compare a model-predicted output with an actual output from building subsystems 428 to determine an accuracy of the model.

Fault detection and diagnostics (FDD) layer 416 can be configured to provide on-going fault detection for building subsystems 428, building subsystem devices (i.e., building equipment), and control algorithms used by demand response layer 414 and integrated control layer 418. FDD layer 416 can receive data inputs from integrated control layer 418, directly from one or more building subsystems or devices, or from another data source. FDD layer 416 can automatically diagnose and respond to detected faults. The responses to detected or diagnosed faults can include providing an alert message to a user, a maintenance scheduling system, or a control algorithm configured to attempt to repair the fault or to work-around the fault.

FDD layer 416 can be configured to output a specific identification of the faulty component or cause of the fault (e.g., loose damper linkage) using detailed subsystem inputs available at building subsystem integration layer 420. In other example embodiments, FDD layer 416 is configured to provide "fault" events to integrated control layer 418 which executes control strategies and policies in response to the received fault events. According to an example embodiment, FDD layer 416 (or a policy executed by an integrated control engine or business rules engine) can shut-down systems or direct control activities around faulty devices or systems to reduce energy waste, extend equipment life, or assure proper control response.

FDD layer 416 can be configured to store or access a variety of different system data stores (or data points for live data). FDD layer 416 can use some content of the data stores to identify faults at the equipment level (e.g., specific chiller, specific AHU, specific terminal unit, etc.) and other content to identify faults at component or subsystem levels. For example, building subsystems 428 can generate temporal (i.e., time-series) data indicating the performance of BMS 400 and the various components thereof. The data generated by building subsystems 428 can include measured or calculated values that exhibit statistical characteristics and provide information about how the corresponding system or process (e.g., a temperature control process, a flow control process, etc.) is performing in terms of error from its setpoint. These processes can be examined by FDD layer 416 to expose when the system begins to degrade in performance and alert a user to repair the fault before it becomes more severe.

Residential HVAC System

Figure 5:
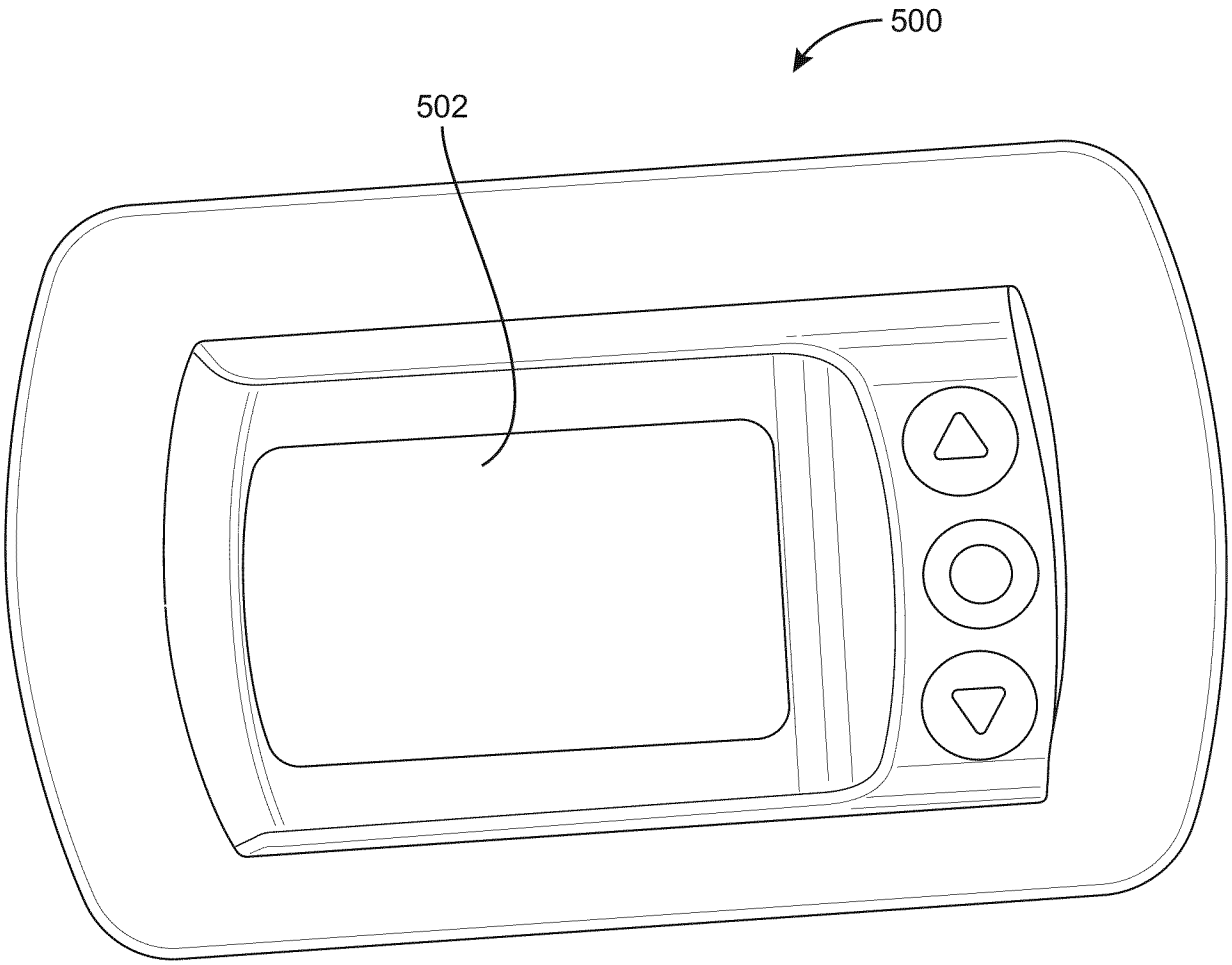
FIG. 5 is a front perspective view of a thermostat, which can be used in the system of FIG. 4, according to some embodiments.

Referring now to FIG. 5, a drawing of a thermostat 500 for controlling building equipment is shown, according to an exemplary embodiment. The thermostat 500 is shown to include a display 502 and can be used with the systems illustrated in FIGS. 1-4. The display 502 may be an interactive display that can display information to a user and receive input from the user. The display may be transparent such that a user can view information on the display and view the surface located behind the display. Details regarding the features of display 502 are discussed in greater detail below with reference to FIGS. 9-13.

Figure 6:
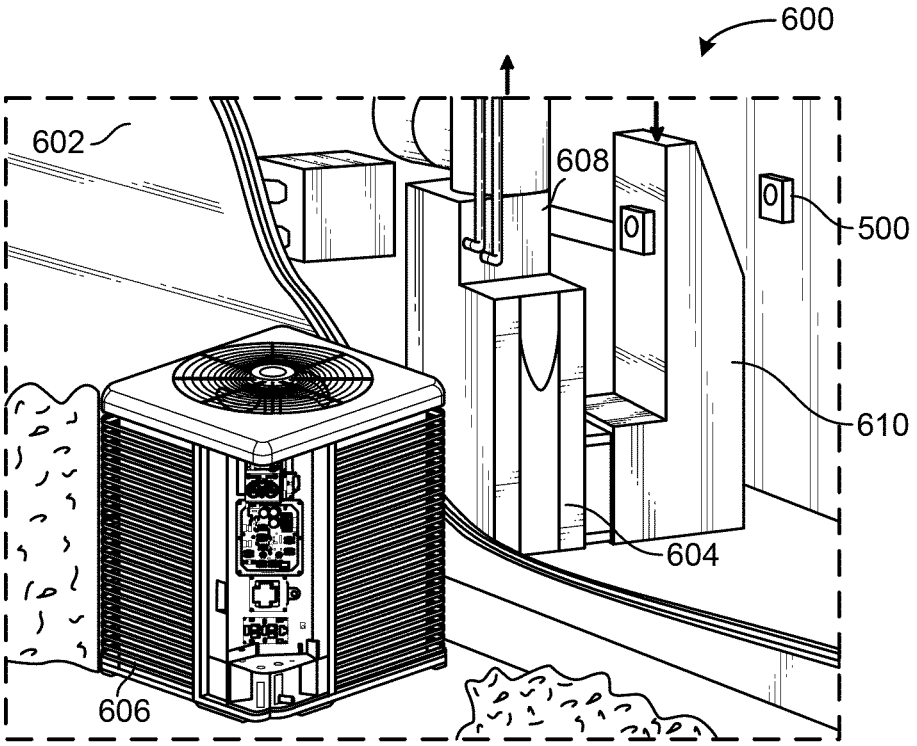
FIG. 6 is a drawing of a heating and cooling residential system, which can be used in the building of FIG. 1, according to some embodiments.

Referring now to FIG. 6, a residential heating and cooling system 600 is shown, according to an exemplary embodiment. The residential heating and cooling system 600 may provide heated and cooled air to a residential structure. Although described as a residential heating and cooling system 600, embodiments of the systems and methods described herein can be utilized in a cooling unit or a heating unit in a variety of applications include commercial HVAC units (e.g., roof top units). In general, a residence 602 includes refrigerant conduits that operatively couple an indoor unit 604 to an outdoor unit 606. Indoor unit 604 may be positioned in a utility space, an attic, a basement, and so forth. Outdoor unit 606 is situated adjacent to a side of residence 602. Refrigerant conduits transfer refrigerant between indoor unit 604 and outdoor unit 606, typically transferring primarily liquid refrigerant in one direction and primarily vaporized refrigerant in an opposite direction.

When the system 600 shown in FIG. 6 is operating as an air conditioner, a coil in outdoor unit 606 serves as a condenser for recondensing vaporized refrigerant flowing from indoor unit 604 to outdoor unit 606 via one of the refrigerant conduits. In these applications, a coil of the indoor unit 604, designated by the reference numeral 508, serves as an evaporator coil. Evaporator coil 608 receives liquid refrigerant (which may be expanded by an expansion device, not shown) and evaporates the refrigerant before returning it to outdoor unit 606.

Outdoor unit 606 draws in environmental air through its sides, forces the air through the outer unit coil using a fan, and expels the air. When operating as an air conditioner, the air is heated by the condenser coil within the outdoor unit 606 and exits the top of the unit at a temperature higher than it entered the sides. Air is blown over indoor coil 608 and is then circulated through residence 602 by means of ductwork 610, as indicated by the arrows entering and exiting ductwork 610. The overall system 600 operates to maintain a desired temperature as set by thermostat 500. When the temperature sensed inside the residence 602 is higher than the set point on the thermostat 500 (with the addition of a relatively small tolerance), the air conditioner will become operative to refrigerate additional air for circulation through the residence 602. When the temperature reaches the set point (with the removal of a relatively small tolerance), the unit can stop the refrigeration cycle temporarily.

In some embodiments, the system 600 configured so that the outdoor unit 606 is controlled to achieve a more elegant control over temperature and humidity within the residence 602. The outdoor unit 606 is controlled to operate components within the outdoor unit 606, and the system 600, based on a percentage of a delta between a minimum operating value of the compressor and a maximum operating value of the compressor plus the minimum operating value. In some embodiments, the minimum operating value and the maximum operating value are based on the determined outdoor ambient temperature, and the percentage of the delta is based on a predefined temperature differential multiplier and one or more time dependent multipliers.

Figure 7:
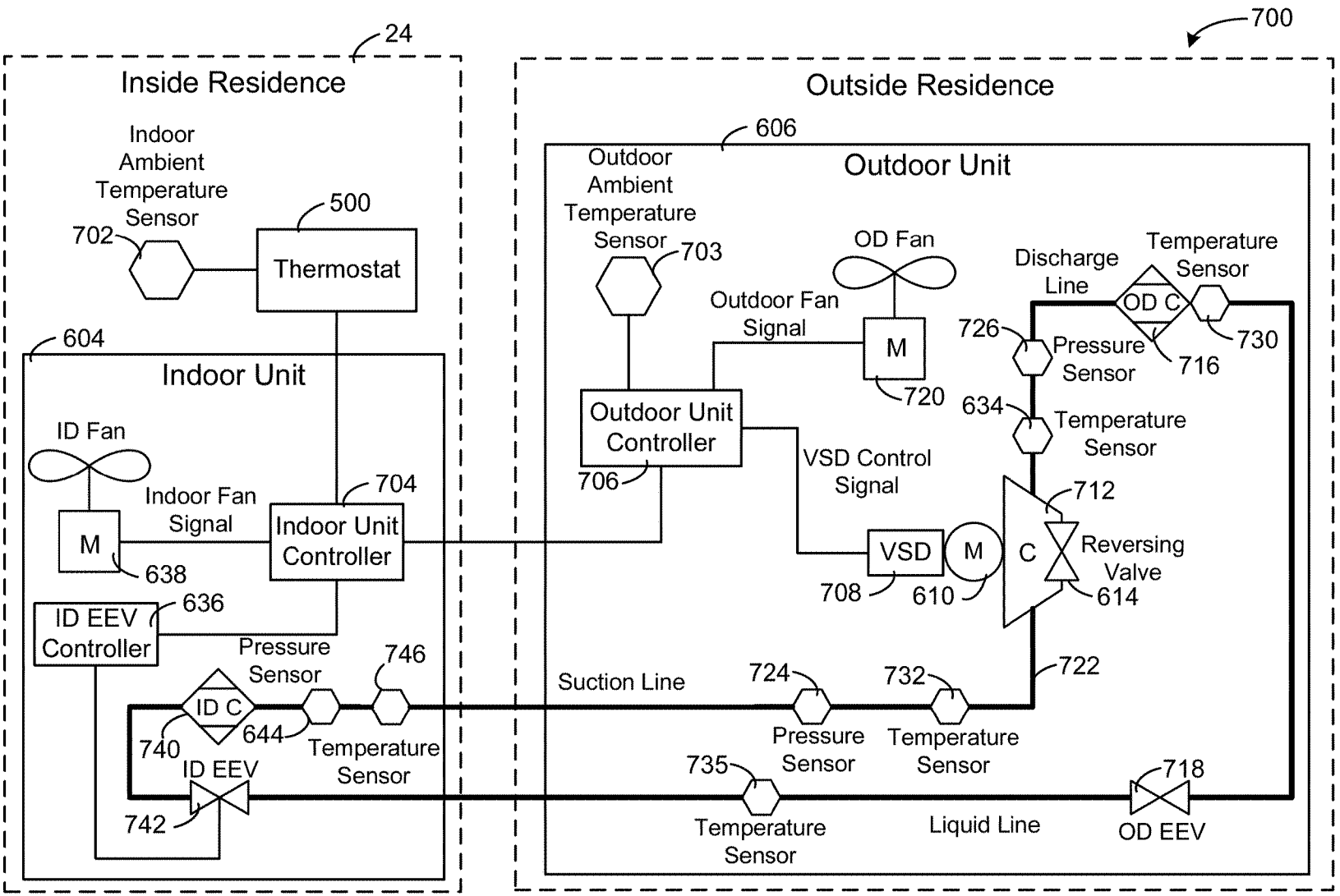
FIG. 7 is a block diagram of a residential HVAC system which can be used in the building of FIG. 1, according to some embodiments.

Referring now to FIG. 7, an HVAC system 700 is shown according to an exemplary embodiment. Various components of system 700 are located inside residence 602 while other components are located outside residence 602. Outdoor unit 606, as described with reference to FIG. 6, is shown to be located outside residence 602 while indoor unit 604 and thermostat 500, as described with reference to FIG. 7, are shown to be located inside the residence 602. In various embodiments, the thermostat 500 can cause the indoor unit 604 and the outdoor unit 606 to heat residence 602. In some embodiments, the thermostat 500 can cause the indoor unit 604 and the outdoor unit 606 to cool the residence 602. In other embodiments, the thermostat 500 can command an airflow change within the residence 602 to adjust the humidity within the residence 602.

The thermostat 500 can be configured to generate control signals for indoor unit 604 and/or outdoor unit 606. The thermostat 500 is shown to be connected to an indoor ambient temperature sensor 702, and an outdoor unit controller 706 is shown to be connected to an outdoor ambient temperature sensor 703. The indoor ambient temperature sensor 702 and the outdoor ambient temperature sensor 703 may be any kind of temperature sensor (e.g., thermistor, thermocouple, etc.). The thermostat 500 may measure the temperature of residence 602 via the indoor ambient temperature sensor 702. Further, the thermostat 500 can be configured to receive the temperature outside residence 602 via communication with the outdoor unit controller 706. In various embodiments, the thermostat 500 generates control signals for the indoor unit 604 and the outdoor unit 606 based on the indoor ambient temperature (e.g., measured via indoor ambient temperature sensor 702), the outdoor temperature (e.g., measured via the outdoor ambient temperature sensor 703), and/or a temperature set point.

The indoor unit 604 and the outdoor unit 606 may be electrically connected. Further, indoor unit 604 and outdoor unit 606 may be coupled via conduits 722. The outdoor unit 606 can be configured to compress refrigerant inside conduits 722 to either heat or cool the building based on the operating mode of the indoor unit 604 and the outdoor unit 606 (e.g., heat pump operation or air conditioning operation). The refrigerant inside conduits 722 may be any fluid that absorbs and extracts heat. For example, the refrigerant may be hydro fluorocarbon (HFC) based R-410A, R-407C, and/or R-134a.

The outdoor unit 606 is shown to include the outdoor unit controller 706, a variable speed drive 708, a motor 710 and a compressor 712. The outdoor unit 606 can be configured to control the compressor 712 and to further cause the compressor 712 to compress the refrigerant inside conduits 722. In this regard, the compressor 712 may be driven by the variable speed drive 708 and the motor 710. For example, the outdoor unit controller 706 can generate control signals for the variable speed drive 708. The variable speed drive 708 (e.g., an inverter, a variable frequency drive, etc.) may be an AC-AC inverter, a DC-AC inverter, and/or any other type of inverter. The variable speed drive 708 can be configured to vary the torque and/or speed of the motor 710 which in turn drives the speed and/or torque of compressor 712. The compressor 712 may be any suitable compressor such as a screw compressor, a reciprocating compressor, a rotary compressor, a swing link compressor, a scroll compressor, or a turbine compressor, etc.

In some embodiments, the outdoor unit controller 706 is configured to process data received from the thermostat 500 to determine operating values for components of the system 700, such as the compressor 712. In one embodiment, the outdoor unit controller 706 is configured to provide the determined operating values for the compressor 712 to the variable speed drive 708, which controls a speed of the compressor 712. The outdoor unit controller 706 is controlled to operate components within the outdoor unit 606, and the indoor unit 604, based on a percentage of a delta between a minimum operating value of the compressor and a maximum operating value of the compressor plus the minimum operating value. In some embodiments, the minimum operating value and the maximum operating value are based on the determined outdoor ambient temperature, and the percentage of the delta is based on a predefined temperature differential multiplier and one or more time dependent multipliers.

In some embodiments, the outdoor unit controller 706 can control a reversing valve 714 to operate system 700 as a heat pump or an air conditioner. For example, the outdoor unit controller 706 may cause reversing valve 714 to direct compressed refrigerant to the indoor coil 608 while in heat pump mode and to an outdoor coil 716 while in air conditioner mode. In this regard, the indoor coil 608 and the outdoor coil 716 can both act as condensers and evaporators depending on the operating mode (i.e., heat pump or air conditioner) of system 700.

Further, in various embodiments, outdoor unit controller 706 can be configured to control and/or receive data from an outdoor electronic expansion valve (EEV) 718. The outdoor electronic expansion valve 718 may be an expansion valve controlled by a stepper motor. In this regard, the outdoor unit controller 706 can be configured to generate a step signal (e.g., a PWM signal) for the outdoor electronic expansion valve 718. Based on the step signal, the outdoor electronic expansion valve 718 can be held fully open, fully closed, partial open, etc. In various embodiments, the outdoor unit controller 706 can be configured to generate step signal for the outdoor electronic expansion valve 718 based on a subcool and/or superheat value calculated from various temperatures and pressures measured in system 700. In one embodiment, the outdoor unit controller 706 is configured to control the position of the outdoor electronic expansion valve 718 based on a percentage of a delta between a minimum operating value of the compressor and a maximum operating value of the compressor plus the minimum operating value. In some embodiments, the minimum operating value and the maximum operating value are based on the determined outdoor ambient temperature, and the percentage of the delta is based on a predefined temperature differential multiplier and one or more time dependent multipliers.

The outdoor unit controller 706 can be configured to control and/or power outdoor fan 720. The outdoor fan 720 can be configured to blow air over the outdoor coil 716. In this regard, the outdoor unit controller 706 can control the amount of air blowing over the outdoor coil 716 by generating control signals to control the speed and/or torque of outdoor fan 720. In some embodiments, the control signals are pulse wave modulated signals (PWM), analog voltage signals (i.e., varying the amplitude of a DC or AC signal), and/or any other type of signal. In one embodiment, the outdoor unit controller 706 can control an operating value of the outdoor fan 720, such as speed, based on a percentage of a delta between a minimum operating value of the compressor and a maximum operating value of the compressor plus the minimum operating value. In some embodiments, the minimum operating value and the maximum operating value are based on the determined outdoor ambient temperature, and the percentage of the delta is based on a predefined temperature differential multiplier and one or more time dependent multipliers.

The outdoor unit 606 may include one or more temperature sensors and one or more pressure sensors. The temperature sensors and pressure sensors may be electrical connected (i.e., via wires, via wireless communication, etc.) to the outdoor unit controller 706. In this regard, the outdoor unit controller 706 can be configured to measure and store the temperatures and pressures of the refrigerant at various locations of the conduits 722. The pressure sensors may be any kind of transducer that can be configured to sense the pressure of the refrigerant in the conduits 722. The outdoor unit 606 is shown to include pressure sensor 724. The pressure sensor 724 may measure the pressure of the refrigerant in conduit 722 in the suction line (i.e., a predefined distance from the inlet of compressor 712). Further, the outdoor unit 606 is shown to include pressure sensor 726. The pressure sensor 726 may be configured to measure the pressure of the refrigerant in conduits 722 on the discharge line (e.g., a predefined distance from the outlet of compressor 712).

The temperature sensors of outdoor unit 606 may include thermistors, thermocouples, and/or any other temperature sensing device. The outdoor unit 606 is shown to include temperature sensor 730, temperature sensor 732, temperature sensor 734, and temperature sensor 736. The temperature sensors (i.e., temperature sensor 730, temperature sensor 732, temperature sensor 735, and/or temperature sensor 746) can be configured to measure the temperature of the refrigerant at various locations inside conduits 722.

Referring now to the indoor unit 604, the indoor unit 604 is shown to include indoor unit controller 704, indoor electronic expansion valve controller 736, an indoor fan 738, an indoor coil 740, an indoor electronic expansion valve 742, a pressure sensor 744, and a temperature sensor 746. The indoor unit controller 704 can be configured to generate control signals for indoor electronic expansion valve controller 742. The signals may be set points (e.g., temperature set point, pressure set point, superheat set point, subcool set point, step value set point, etc.). In this regard, indoor electronic expansion valve controller 736 can be configured to generate control signals for indoor electronic expansion valve 742. In various embodiments, indoor electronic expansion valve 742 may be the same type of valve as outdoor electronic expansion valve 718. In this regard, indoor electronic expansion valve controller 736 can be configured to generate a step control signal (e.g., a PWM wave) for controlling the stepper motor of the indoor electronic expansion valve 742. In this regard, indoor electronic expansion valve controller 736 can be configured to fully open, fully close, or partially close the indoor electronic expansion valve 742 based on the step signal.

Indoor unit controller 704 can be configured to control indoor fan 738. The indoor fan 738 can be configured to blow air over indoor coil 740. In this regard, the indoor unit controller 704 can control the amount of air blowing over the indoor coil 740 by generating control signals to control the speed and/or torque of the indoor fan 738. In some embodiments, the control signals are pulse wave modulated signals (PWM), analog voltage signals (i.e., varying the amplitude of a DC or AC signal), and/or any other type of signal. In one embodiment, the indoor unit controller 704 may receive a signal from the outdoor unit controller indicating one or more operating values, such as speed for the indoor fan 738. In one embodiment, the operating value associated with the indoor fan 738 is an airflow, such as cubic feet per minute (CFM). In one embodiment, the outdoor unit controller 706 may determine the operating value of the indoor fan based on a percentage of a delta between a minimum operating value of the compressor and a maximum operating value of the compressor plus the minimum operating value. In some embodiments, the minimum operating value and the maximum operating value are based on the determined outdoor ambient temperature, and the percentage of the delta is based on a predefined temperature differential multiplier and one or more time dependent multipliers.

The indoor unit controller 704 may be electrically connected (e.g., wired connection, wireless connection, etc.) to pressure sensor 744 and/or temperature sensor 746. In this regard, the indoor unit controller 704 can take pressure and/or temperature sensing measurements via pressure sensor 744 and/or temperature sensor 746. In one embodiment, pressure sensor 744 and temperature sensor 746 are located on the suction line (i.e., a predefined distance from indoor coil 740). In other embodiments, the pressure sensor 744 and/or the temperature sensor 746 may be located on the liquid line (i.e., a predefined distance from indoor coil 740).

Detailed Residential HVAC System

Figure 8A:
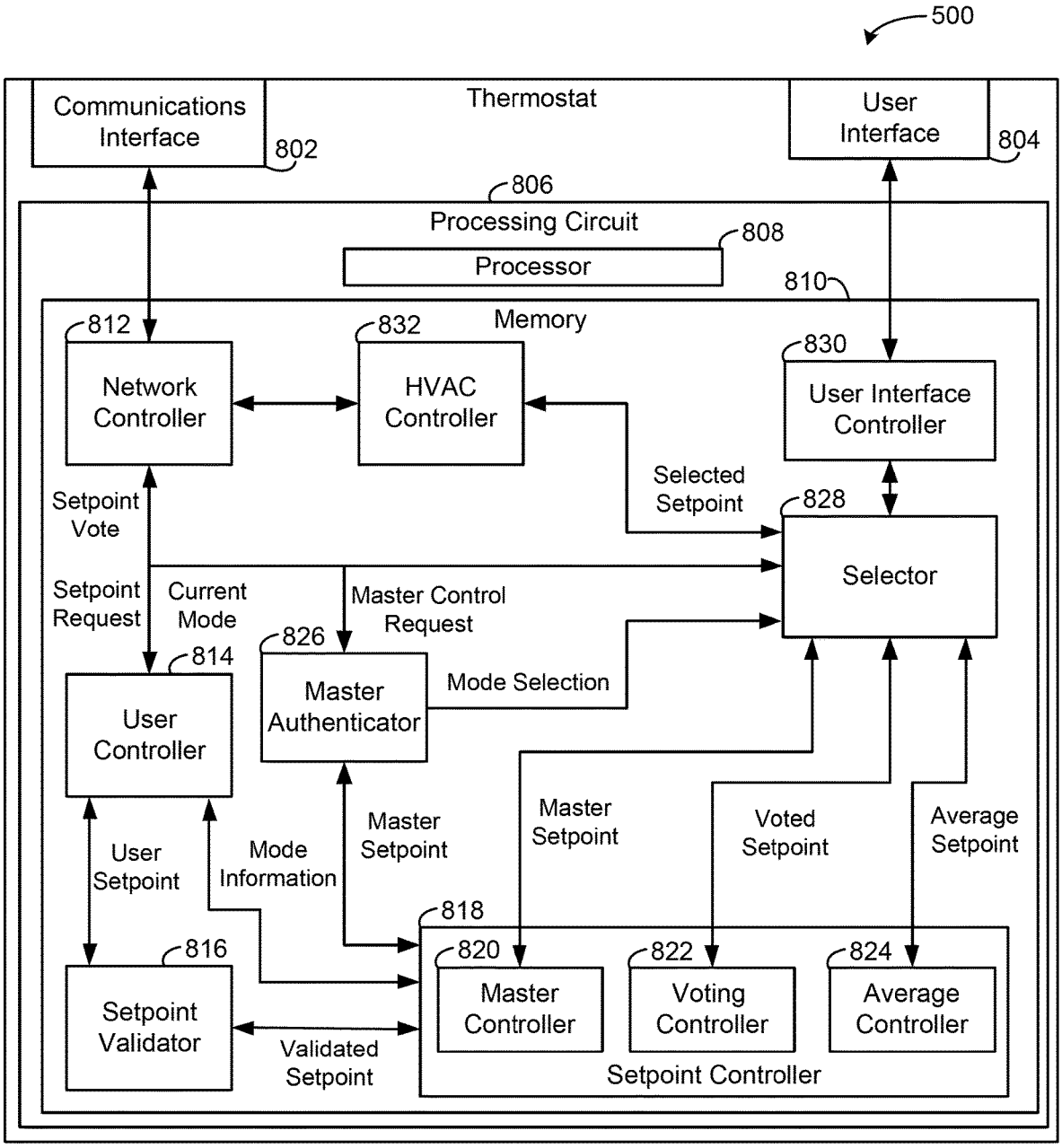
FIG. 8A is a block diagram of a thermostat, which can be used in the thermostat of FIG. 5, according to some embodiments.

Referring now to FIG. 8A, a block diagram illustrating thermostat 500 in greater detail is shown, according to an exemplary embodiment. Thermostat 500 is shown to include a communications interface 802, a user interface 504, and a processing circuit 806. Communications interface 802 can be configured to communicate via local area networks (e.g., a building LAN), wide area networks (e.g., the Internet, a cellular network, etc.), conduct direct communications (e.g., NFC, Bluetooth, etc.) ad hoc with devices (e.g., ad hoc Wi-Fi, ad hoc Zigbee, ad hoc Bluetooth, NFC etc.), and/or with ad hoc networks (e.g., MANET, a VANET, a SPAN, an IMANET, and any other ad hoc network).

Communications interface 802 may be the physical medium through which thermostat 500 communicates with HVAC equipment 404 or various user devices (not shown). In some embodiments, communications interface 802 includes various connectors, amplifiers, filters, controllers, transformers, radios, impedance matching circuits, and/or any other component necessary for communicating with various systems, devices, and/or equipment. In some embodiments, communications interface 802 can include one or more wireless transceivers (e.g., a Wi-Fi transceiver, a Bluetooth transceiver, a NFC transceiver, a cellular transceiver, etc.) for communicating with mobile devices.

User interface 504 may be configured to display images and/or content to a user and receive input from a user. In some embodiments, user interface 504 is at least one of a capacitive touch screen, a projective capacitive touch screen, a resistive touch screen, a LCD screen, a LED screen, and/or any other screen, touch screen and/or combination of screen and/or touch screen. In various embodiments, user interface 504 includes various buttons and/or switches for receiving various inputs. Details regarding user interface 504 are described in greater detail below with reference to FIGS. 9-13.

Processing circuit 806 is shown to include a processor 808 and memory 810. Processor 808 can be a general purpose or specific purpose processor, an application specific integrated circuit (ASIC), one or more field programmable gate arrays (FPGAs), a group of processing components, and/or other suitable processing components. Processor 808 may be configured to execute computer code and/or instructions stored in memory 810 or received from other computer readable media (e.g., CDROM, network storage, a remote server, etc.).

Memory 810 can include one or more devices (e.g., memory units, memory devices, storage devices, etc.) for storing data and/or computer code for completing and/or facilitating the various processes described in the present disclosure. Memory 810 can include random access memory (RAM), read-only memory (ROM), hard drive storage, temporary storage, non-volatile memory, flash memory, optical memory, or any other suitable memory for storing software objects and/or computer instructions. Memory 810 can include database components, object code components, script components, or any other type of information structure for supporting the various activities and information structures described in the present disclosure. Memory 810 can be communicably connected to processor 808 via processing circuit 806 and can include computer code for executing (e.g., by processor 808) one or more processes described herein.

Memory 810 is shown to include network controller 812. In various embodiments, network controller 812 includes commands to implement various network protocols and/or communications by controlling communications interface 802. In some embodiments, network controller 812 is configured to operate one or a combinations of a Wi-Fi network, a wired Ethernet network, a Zigbee network, and a Bluetooth network. In some embodiments, network controller 812 operates an HVAC network. In various embodiments, the HVAC network uses a proprietary communication protocol. Network controller 812 can be configured to control communications interface 802 to operate a local area network or a wide area network (e.g., the Internet, a building WAN, etc.) and may use a variety of communications protocols (e.g., N2, BACnet, BACnet MS/TP, IP, LON, etc.) In various embodiments, the communications protocols may be physically implemented over RS-485, RS-232, RS-422, PS/2, USB, fire wire, Ethernet, Zigbee, Wi-Fi, etc. In some embodiments, the communications protocol is for an adhoc connection (e.g., ad hoc Wi-Fi, ad hoc Zigbee, ad hoc Bluetooth, NFC, etc.) In some embodiments, the protocol is for a MANET, a VANET, a SPAN, an IMANET, and/or any other ad hoc network In some embodiments, network controller 812 is configured to receive setpoint requests from one or more user devices. In some embodiments, network controller 812 sends a setpoint request to user controller 814. The setpoint request may include a setpoint and a length of time that the user of the user device will be in a zone and/or building controlled by thermostat 500. In various embodiments, the setpoint requests are received via user interface 504.

User controller 814 can be configured to handle all setpoint requests received from a user device. In some embodiments, user controller 814 receives an operating mode from selector 828, based on the operating mode received from selector 828, user controller 814 can be configured to send the requested setpoint to setpoint validator 816 or send a message to the user device. When the mode is average mode, user controller 814 may be configured to send the requested setpoint to setpoint validator 816. If the mode is master mode, user controller 814 may send a message to the user device identifying the current master of thermostat 500 and inform the user of the user device that they are not authorized to change the setpoint. Identifying the master may be sending a picture of the master, sending a name of the master, and/or sending contact information of the master. The master may be the master user associated with master device 414. In various embodiments, a message may be sent to a current master allowing the master (i.e., master user) to accept the requested setpoint and/or reject the requested setpoint. When the operating mode of thermostat 500 is average mode, the user may receive a message via the user device asking if the user wishes to begin a vote among all users linked (i.e., logged in) to thermostat 500 regarding the requested setpoint. In various embodiments, a user can send a command from their user device to user controller 814 to begin a vote for a setpoint.

Setpoint validator 816 may be configured to filter setpoint requests received from user controller 814. In some embodiments, setpoint validator 816 identifies if the requested setpoint is within a predefined setpoint range. If the setpoint is outside the predefined range, the setpoint validator 816 may be configured to send a message to the user device informing the user of the user device that the setpoint that they have requested is invalid and/or is outside a proper operating range. In various embodiments, the predefined range is a range surrounding the current average setpoint.

The predefined range may prevent an individual from driving an average up and/or down by requesting an extreme setpoint (i.e., a temperature outside the predefined range). In some embodiments, the predefined setpoint range corresponds to an operating range of HVAC equipment 404. In various embodiments, the predefined setpoint range corresponds to an operating range which will not damage (i.e., continuously run) the HVAC equipment 404.

Setpoint validator 816 may be configured to validate a setpoint based on a time-to-setpoint associated with the setpoint. In some embodiments, the time-to-setpoint is determined from the setpoint received from the user controller 814. Setpoint validator 816 may store various information about any HVAC equipment (e.g., HVAC equipment 404) connected to thermostat 500. In some embodiments, the information includes a data table linking the time-to-setpoint associated with various setpoints (i.e., a lookup table). User controller 814 may store various technical specifications regarding the connected HVAC equipment. In some embodiments, various equipment models and/or calculation methods can be used to determine the time-to-setpoint based on the technical specifications. In some embodiments, setpoint validator 816 is configured to communicate with HVAC controller 832 and record, based on the operation of HVAC controller 832, various time-to-setpoints associated with setpoints and ambient zone temperatures. Based on the recordings, a historical model may be generated that can be used to determine time-to-setpoints based on the requested setpoint and/or the ambient temperature. An example of a thermostat determining a time-to-setpoint value is described in detail in U.S. patent application Ser. No. 15/260,298 filed Sep. 8, 2016.

Setpoint validator 816 can be configured to compare the time-to-setpoint determined for the setpoint received from user controller 814 to a length of time which the requesting user is anticipated to be in a zone controlled by thermostat 500. The setpoint request received by setpoint validator 816 may include and/or be accompanied by the length of time which the requesting user will be in the zone controlled by thermostat 500. In some embodiments, setpoint validator 816 is configured to validate the setpoint by comparing the time-to-setpoint determined for the requested setpoint to the length of time which the requesting user will be in the zone controlled by thermostat 500. In some embodiments, a setpoint that has a time-to-setpoint a predefined amount of time less than the length of time the requesting user will be in the zone is validated and sent to setpoint controller 818. In various embodiments, a setpoint that has a time-to-setpoint longer than a predefined amount of time is determined to be illegitimate and is not sent to setpoint controller 818, or may be ignored by setpoint controller 818. In various embodiments, a setpoint that has a time-to-setpoint longer than an amount of time the user will be in the zone controlled by the thermostat may be ignored by setpoint controller 818.

Master authenticator 826 may be configured to identify and/or authenticate a master and/or master device (e.g., master device 414). In some embodiments, master authenticator 826 causes a login screen to appear on the master device (i.e., display 416) and/or user interface 504 of thermostat 500 and causes the master (i.e., the user) of the master device to enter a user name and/or password to authenticate the master device with thermostat 500. In various embodiments, a unique device identifier is used to automatically authenticate with thermostat 500. In various embodiment's, the unique device identifier is at least one of a MAC address, a UDID, a UDIF, an android device identifier, and/or any other device identifier. Further, various master setpoint requests, mode selections, and/or any other information can be received by master authenticator from master device 414 and/or user interface 504.

Selector 828 may be configured to receive a mode selection from master authenticator 826. In some embodiments, selector 828 may be configured to activate and/or deactivate at least one of master controller 820, voting controller 822, and/or average controller 824. In some embodiments, selector 828 may be a three-to-one multiplexer. Selector 828 may be configured to select between the master setpoint received from master controller 820, the voted setpoint received form voting controller 822, and the average setpoint received from average controller 824. Selector 828 is shown to send the selected and/or received setpoint to HVAC controller 832. In some embodiments, selector 828 is configured to activate and/or select at least one of master controller 820, voting controller 822, and average controller 824 based on a mode selection received from a master authenticator 826.

In some embodiments, user interface controller 830 is configured to control the operation of user interface 504. User interface controller 830 can be configured to display content (i.e., images, text, videos, etc.) to a user and receive input from the user. User interface controller 830 may be configured to display the current setpoint on user interface 504. In various embodiments, user interface controller 830 allows a master (i.e., the current master) to access the thermostat 500, authenticate with master authenticator 826, select an operating mode for selector 828, and/or send a master setpoint to setpoint controller 818.

User interface controller 830 may display the identity of the current thermostat master. In various embodiments, when a user tries to adjust the setpoint via user interface 504, user interface controller 830 is configured to alert the user that the user is unable to change the setpoint. User interface controller 830 may also be configured to display the identity of the thermostat master and may display picture of the face of the thermostat master.

User interface controller 830 may also be configured to allow a user to login with thermostat 500, request a setpoint via user interface 504, and/or initiate a vote via user controller 814 and user interface 504. In some embodiments, a master can login via user interface 504, set the operating mode of thermostat 500, set the master setpoint, and/or perform any other action. In various embodiments, any action that can be performed via thermostat application 418 can be performed via user interface 504 and/or user interface controller 830. In various embodiments, a user may interact with user interface 504 to initiate a setpoint vote. The setpoint vote may cause various devices in the zone of that thermostat 500 is located in to receive a notification of a setpoint vote and a prompt to participate in the vote. In various embodiments, some and/or all the functionality of user controller 814 and master authenticator 826 can be performed by user interface controller 830 and user interface 504.

HVAC controller 832 can be configured to control HVAC equipment (e.g., HVAC equipment 404) to a temperature setpoint. HVAC controller 832 can be configured to cause HVAC equipment to heat and/or cool a zone of a building (e.g., building 10) and/or the entire building. In various embodiments, HVAC controller 832 can be configured to send a setpoint to building management system 406. Building management system 606 can be configured to control the HVAC equipment 404 to the setpoint received from HVAC controller 832. HVAC controller 832 is shown to receive a selected setpoint from selector 828. In various embodiments, the selected setpoint is a master setpoint generated and/or determined by master controller 820, a voted setpoint generated and/or determined by voting controller 822, and/or an average setpoint generated and/or determined by average controller 824. HVAC controller 832 can be configured to control and/or generate control signals for HVAC equipment (e.g., HVAC equipment 404). Controlling the HVAC equipment may cause the HVAC equipment to the selected setpoint and/or may cause building management system 606 to control the HVAC equipment to control the ambient temperature of a zone and/or building to the selected setpoint.

HVAC controller 832 may use any of a variety of control algorithms (e.g., state-based algorithms, extremum-seeking control algorithms, proportional algorithms, proportional integral algorithms, PID control algorithms, model predictive control algorithms, feedback control algorithms, etc.) to determine appropriate control actions for any HVAC equipment as a function of temperature and/or humidity. For example, if the ambient temperature of a zone and/or a building (e.g., building 10) is above a temperature set point, HVAC controller 832 may determine that a cooling coil and/or a fan should be activated to decrease the temperature of an supply air delivered to a building zone. Similarly, if the ambient temperature is below the temperature set point, HVAC controller 832 may determine that a heating coil and/or a fan should be activated to increase the temperature of the supply air delivered to the building zone. HVAC controller 832 may determine that a humidification or dehumidification component of the HVAC equipment should be activated or deactivated to control the ambient relative humidity to a humidity set point for a building zone and/or the building.

Figure 8B:
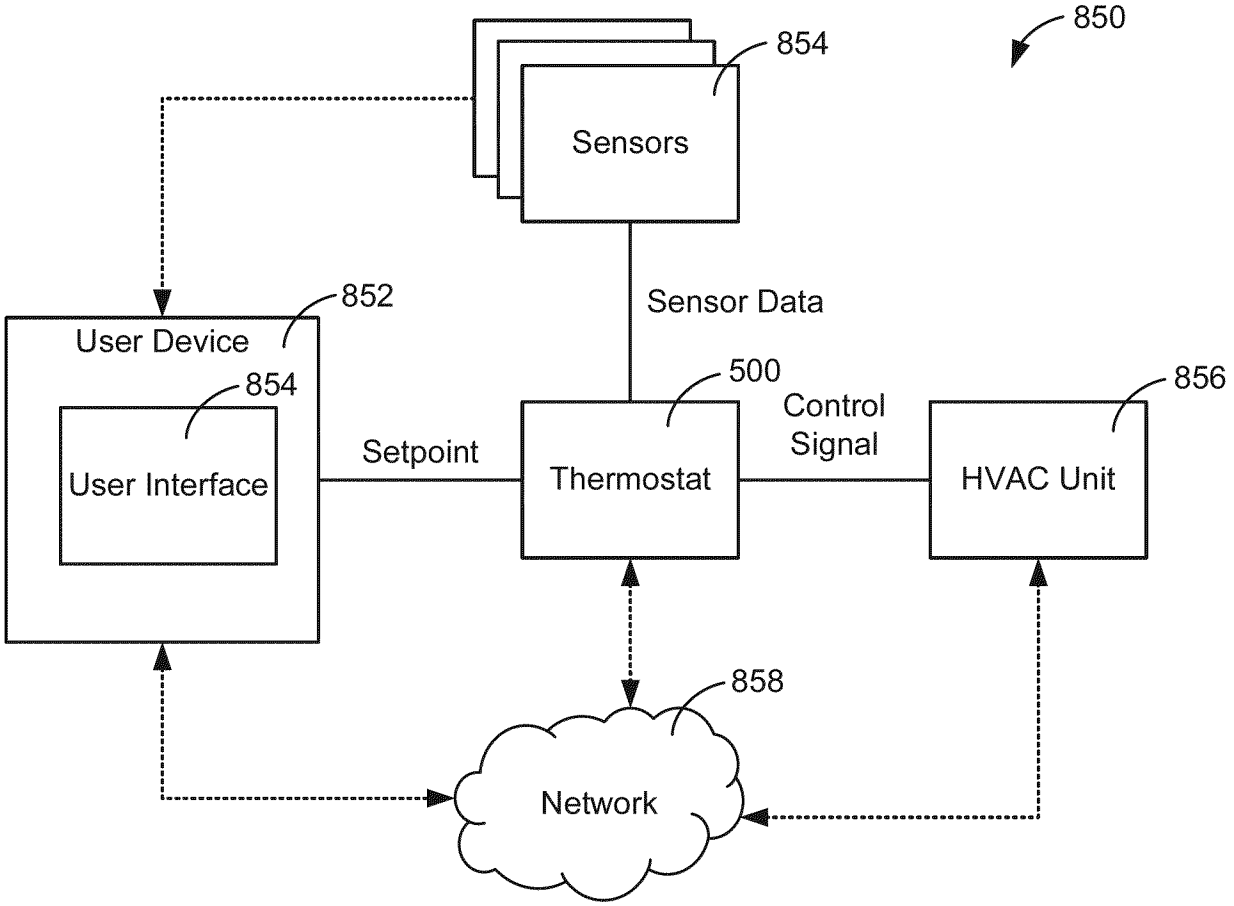
FIG. 8B is a thermostat system which can be used in the building of FIG. 1, according to some embodiments.

Referring now to FIG. 8B, a system diagram of system 850 is shown, according to some embodiments. System 850 may be identical or substantially similar to heating and cooling system 600, in some embodiments. System 850 is shown to include user device 852, sensors 854, thermostat 500, HVAC unit 856, and network 858.

User device 852 may be configured to provide a setpoint to thermostat 500, receive sensor data from sensors 854, or interact with HVAC unit 856 directly (not shown). Communication between user device 852 and one or more components of system 850 may be performed via wired or wireless connection. For example, a user may select a temperature setpoint for thermostat 500 via user interface 854. User device 852 may then wirelessly transmit the signal to thermostat via a transceiver (e.g., Wi-Fi module, radio, etc.) via network 858. In various embodiments, user device 852 includes cell phones, tablets, personal computers (PC's), building management interfaces, and other computers that include a user interface.

Sensors 854 may be configured to record one or more measurements of the environment in which system 850 is located. In some embodiments, sensors 854 are configured to monitor temperature within a particular building zone of system 850. Sensors 854 may be identical or substantially similar to temperature sensor 730, 732, 735, 703, 746, 702, or any combination thereof. HVAC unit 856 may include fans, heaters, boilers, chillers, air handling units, coils, and any components included therein.

Network 858 may be a local area network (e.g., a building LAN), wide area network (e.g., the Internet, a cellular network, etc.), allow for direct communications (e.g., NFC, Bluetooth, etc.) ad hoc with devices (e.g., ad hoc Wi-Fi, ad hoc Zigbee, ad hoc Bluetooth, NFC etc.), and/or with ad hoc networks (e.g., MANET, a VANET, a SPAN, an IMANET, and any other ad hoc network). Network 858 may be identical or substantially similar to network 446.

Segmented Display

Referring generally to FIGS. 9-13, different embodiments of display 502 for thermostat 500 are shown, according to some embodiments. FIGS. 9-13 may represent different embodiments of a display for a single thermostat application or setting within thermostat 500. Display 502 can include multiple different configurations to view information regarding system 850 and is not limited to the embodiments disclosed herein.

Figure 9A:
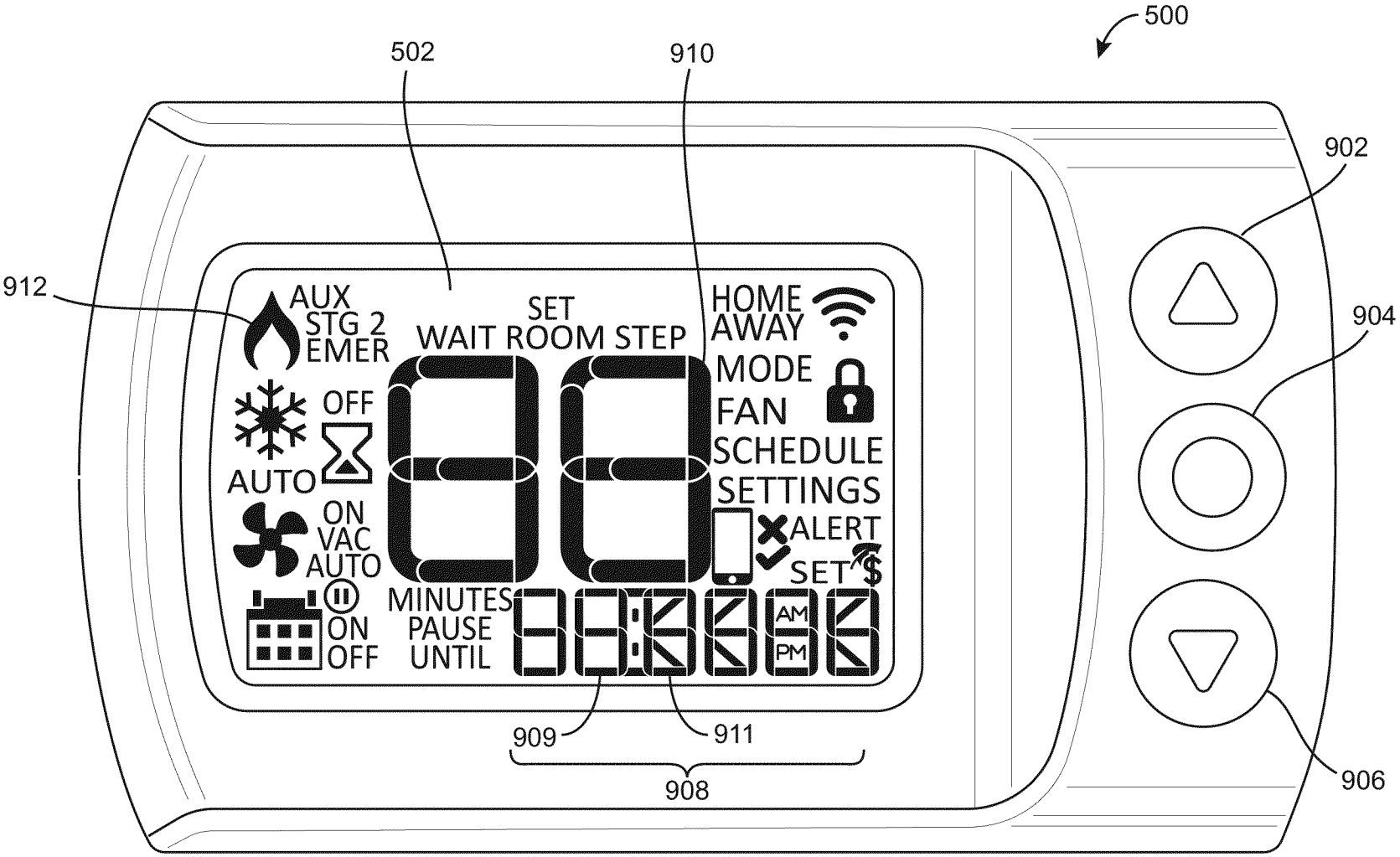
FIG. 9A is a front perspective view of a thermostat, which can be used in the system of FIG. 8B, according to some embodiments.

Referring to FIG. 9A, thermostat 500 includes top button 902, center button 904, and bottom button 906, and display 502. Display 502 includes segments 908, 7-segment character 909, character 911, temperature 910, and icons 912. Buttons 902-906 may be configured to allow a user to interact with thermostat 500. For example, a user may press center button 904 to bring up a menu on display 502. The menu may include temperature settings, temperature modes, device information (e.g., status of furnace, air conditioning unit, boilers, chillers, etc.), setpoint settings, or other settings typically found in thermostat menus. Top button 902 and bottom button 906 may be used to select through a series of choices on a menu. For example, buttons 902, 906 may be allow a user to switch from a "settings" page to a "devices" page, where the devices page outlines all of the devices connected to system 850. In some embodiments, buttons 902-906 are configured to allow a user to select between different temperature settings (e.g., setpoints, enabling AC, enabling heat, etc.). For example, a user may interact with top button 902 to increase temperature 910 or interact with bottom button to decrease temperature 910.

Segments 908 may configured to represent any type of segmented image, icon, character, or number on display 502. Segments 908 may be electrically connected to a device in any form that electronically displays numerals, letters, or images using segment displays, such as display 502. In some embodiments, one or more segments 908 are grouped together (e.g., seven, nine, fourteen, etc.) such that the segments are arranged to display various letters or numbers (i.e., a character). For example, seven segments may be included within a certain device (e.g., liquid crystal display devices, electrochromic display devices, etc.) such that a 7-segment display device illuminates a character on display 502, such as 7-segment character 909. The 7-segment display device may also include a decimal point package.

In some embodiments, each segment of 7-segment (7-seg) character 909 is electrically connected to a pin (i.e., input/output port) that runs to the processing circuit (e.g., processing circuit 806) of the thermostat (e.g. thermostat 500). The combination of the illuminated segments of 7-seg character 909, electrical circuitry, and pins may be referred to as the 7-seg package. All of the cathodes (i.e., negative terminals) or all of anodes (i.e., positive terminals) of the 7-seg package may be connected and brought out to a common pin, allowing the 7-seg package to only require nine pins (e.g., one pine for each digit, one for the decimal point, and one for the negative terminals). The 7-seg package may receive instructions from processing circuit 806 to provide voltage to one or more light generators (e.g., LCD, LED, etc.) that illuminates the respective segment of the 7-seg package. The orientation of the various pins that are tied to various portions of the 7-seg package may be referred to as the "pinout" for the 7-seg package and may disclose which pins are electrically connected to the respective segments in the 7-seg package. For example, the pinout for a particular 7-seg package that is arranged in the typical "8"

shape, may indicate that the top-left segment is pin 9, the bottom-left segment is pin 1, and the bottom segment is pin 2, with pin 3 tied to ground. Processing circuit 806 may provide voltage to pins 1, 2, and 9 to illuminate an "L" symbol on display 502.

Figure 12:
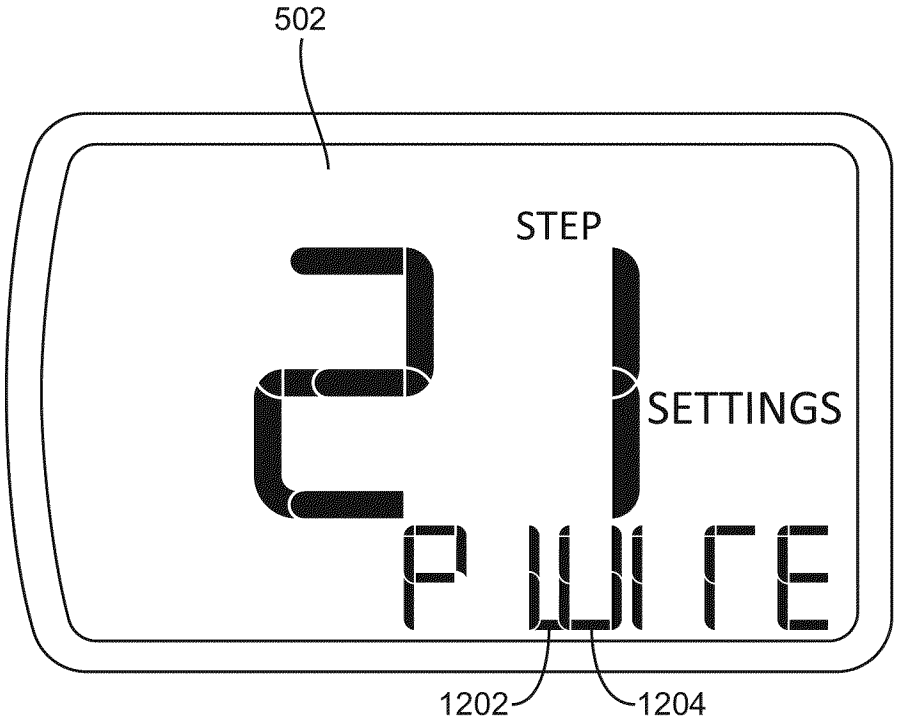
FIG. 12 is a front perspective view of a thermostat, which can be used in the system of FIG. 8B, according to some embodiments.

Still referring to FIG. 9A, display 502 is shown to include character 911. Character 911 may be identical or substantially similar to 7-seg character 909. In other embodiments, character 911 includes more than 7 segments to illuminate a numeral, symbol or character that is more detailed than 7-seg character 909. In various embodiments, more than 7 segments are included within a segment package (e.g., 9-seg package, 14-seg package, etc.) allowing for more illuminated segments of the character, allowing more detail and/or flexibility in displaying character information. The additional segments may be incorporated between the spacing of the original seven segments, such as inside of the character. For example, display 502 illuminates the letter "W", as shown in FIG. 12. This may be accomplished by incorporating one or more characters with a segment package greater than 7, wherein the larger package includes a segment that allows for connection between a first character 1202 and a second character 1204. Details regarding this and different letters that can be illuminated from incorporating a second character having greater than 7 segments is discussed in greater detail below.

Figure 9B:
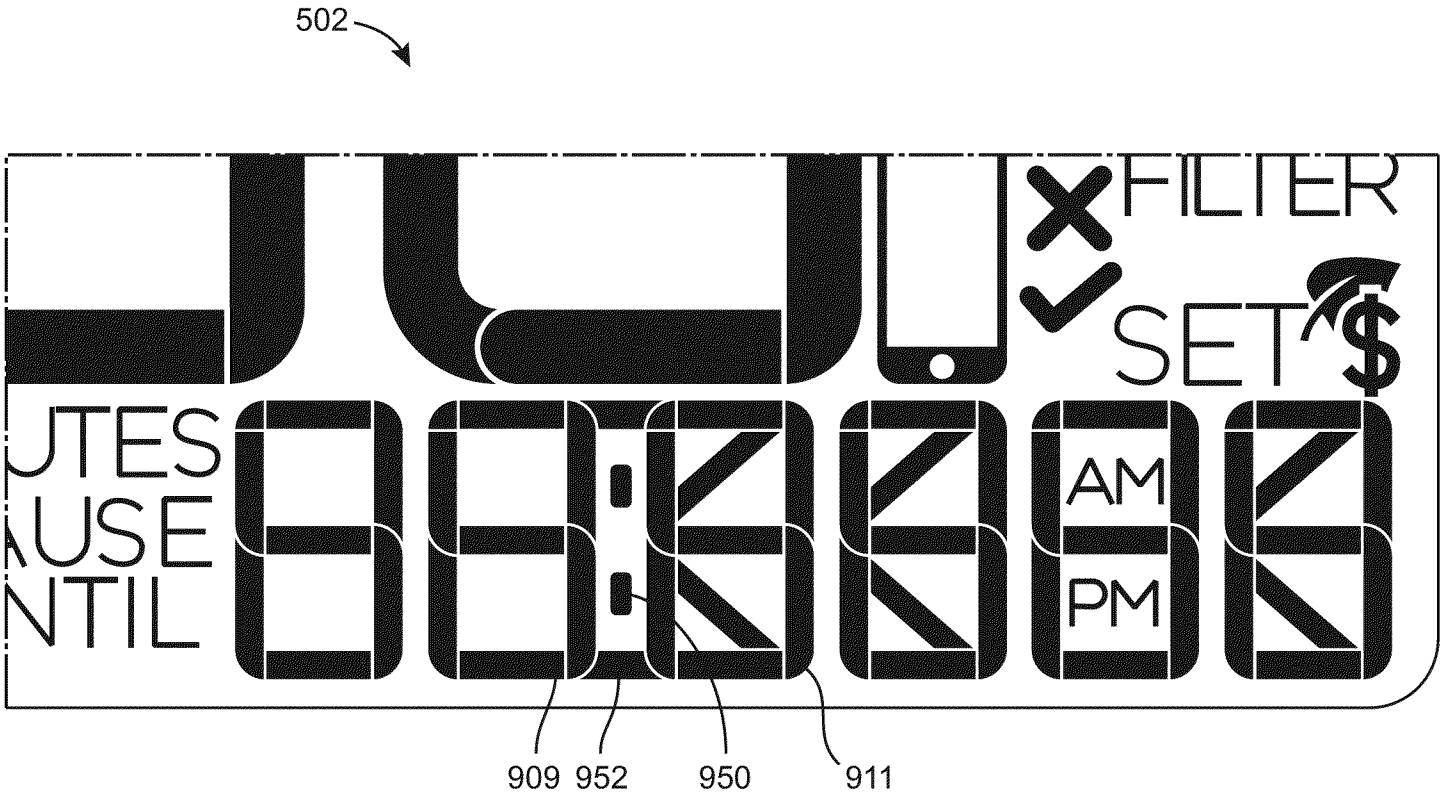
FIG. 9B is a detailed front perspective view of a thermostat, which can be used in the system of FIG. 8B, according to some embodiments.

Referring now to FIG. 9B, a detailed embodiment of a portion of display 502 is shown. Display 502 is shown to include 7-seg character 909, connecting segment 952, colon segment 950, and character 911. Connecting segment 952 may be a segment of the character 911, as character 911 may have more than seven segments within its segment package. In some embodiments, connecting segment 952 may include a bottom connecting segment (shown in FIG. 9B), a top connecting segment (not shown), or both. Colon segment 950 may be an additional segment or segments that are included within the package of character 911. For example, Character 911 may include a segment package greater than seven segments that includes the original seven segments (i.e., top and bottom segments, four side segments, horizontal segment), two diagonal segments, two colon segments, two connecting segments, and a decimal point segment.

Figure 9C:
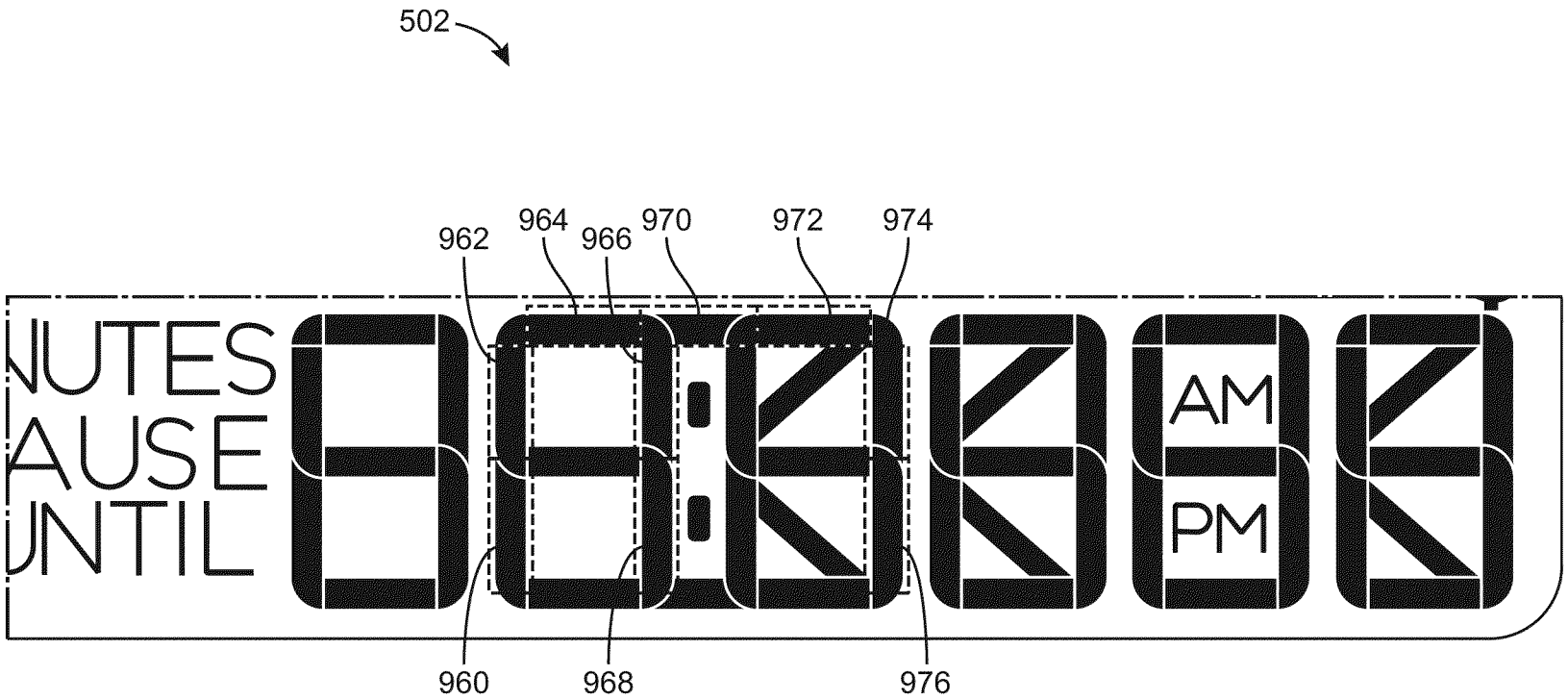
FIG. 9C is a front perspective view of a thermostat, which can be used in the system of FIG. 8B, according to some embodiments.

Referring now to FIG. 9C, the letter "M" is illuminated by implementing two segment display packages proximate to each other with at least one package having greater than 7 segments, according to some embodiments. The package having more than 7-segments may further include a connection segment at the top of the first and second digit. To illuminate the letter "M," processing circuit 808 may provide instructions to illuminate the left side (i.e., the top-left segment and bottom-left segment) of the first character, the top segment of the first character, either the right side (i.e., the top-right segment and bottom-right segment) of the first character or the left side of the second character, the top connection piece, the top segment of the second character, and the right side of the second character. In such an embodiment, the letter "M" is illuminated. The letter "W" may be illuminated similarly, by illuminating the bottom segment of the first character, bottom connection piece, and bottom segment of the second character instead of the top segment of the first digit, top connection piece, and top segment of the second character, respectively. For example, FIG. 9C is shown to include segments 960-976. Other letters may also be illuminated using the connection pieces (e.g., letter "t," etc.). Processing circuit may provide instructions to illuminate a portion of 7-seg character 909 (e.g., segments 960, 962, and 964), segment 970, and a portion of character 911 (e.g., segments 972, 974, 976). This may result in the letter "M" being illuminated.

Figure 9D:
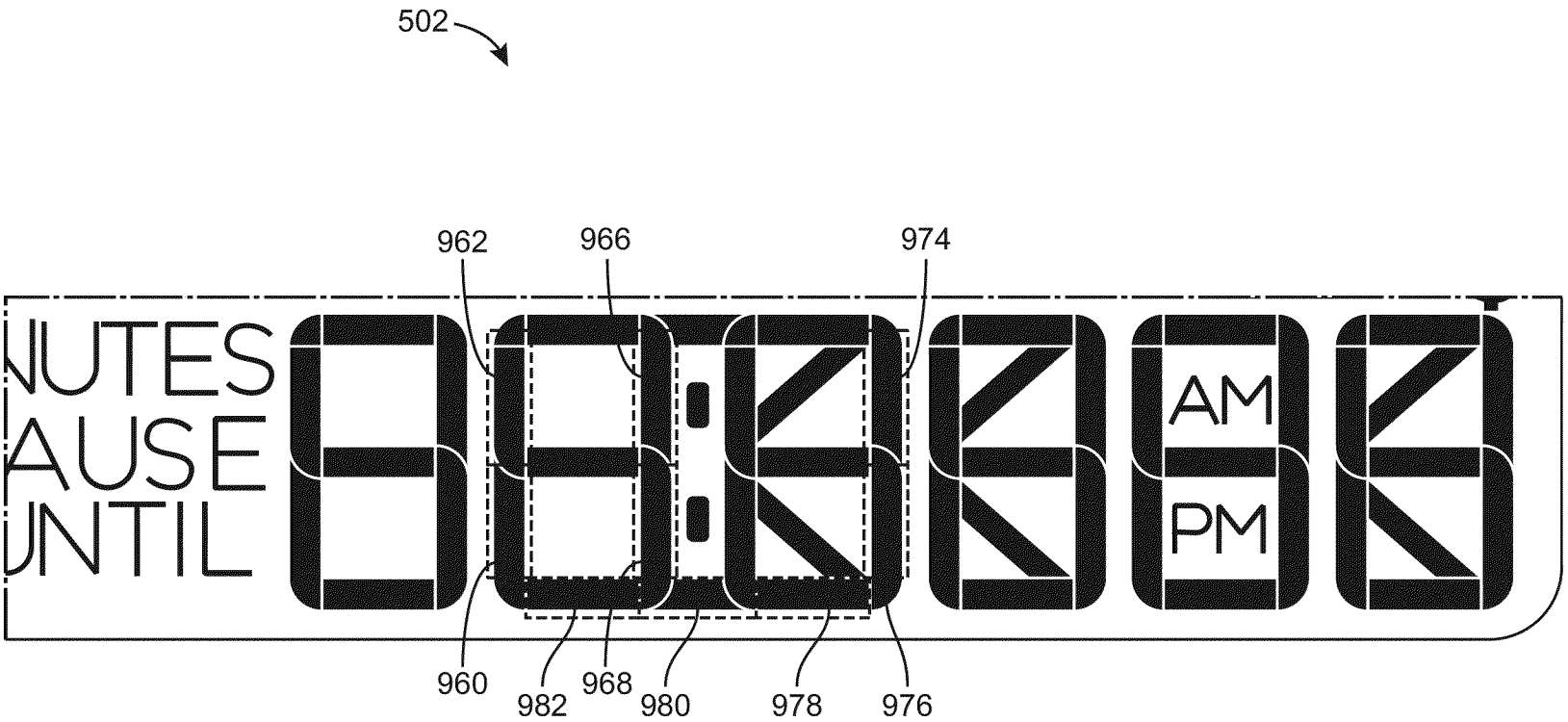
FIG. 9D is a detailed front perspective view of a thermostat, which can be used in the system of FIG. 8B, according to some embodiments.

Referring now to FIG. 9D, the letter "W" is illuminated by implementing two segment display packages proximate to each other with at least one package having greater than 7 segments. In this embodiment, processing circuit 806 may provide instructions to illuminate the top-left segment bottom-left segment, and bottom segment of the first character, the connecting segment, and the top-right segment and the bottom-right segment of the second character to illuminate the letter "M." For example, FIG. 9D is shown to include segments 960-968 and segments 974-982. Processing circuit may provide instructions to illuminate a portion of 7-seg character 909 (e.g., segments 960, 962, and 980), segment 980, and a portion of character 911 (e.g., segments 974, 976, and 978). This may result in the letter "W" being illuminated.

Referring now to FIG. 12, display 502 is shows first character 1202 second character. First character may be identical or substantially similar in functionality to 7-seg character 909. In some embodiments, second character 1204 includes 9 segments within a 9-segment (9-seg) package. In other embodiments, second character 1204 includes at least 14 segments within a 14-segment (14-seg) package. Second character 1204 may include segments outside of the respective character, such as additional horizontal or vertical segments, dots, diagonal segments, or any combination thereof. In some embodiments, the additional segments are arranged such that a colon, semi-colon, or other symbol may be illuminated before or after the character. In other embodiments, the additional segments are arranged such that a connection segment may be located before or after the character, such that another character may connect behind of or in front of the character, respectively. This is shown in FIGS. 9A-B wherein character 911, which includes more than 7 segments, connects to a 7-seg character behind it (i.e., 7-seg character 909) by means of connection segments at the bottom and top of the digits.

Figure 10:
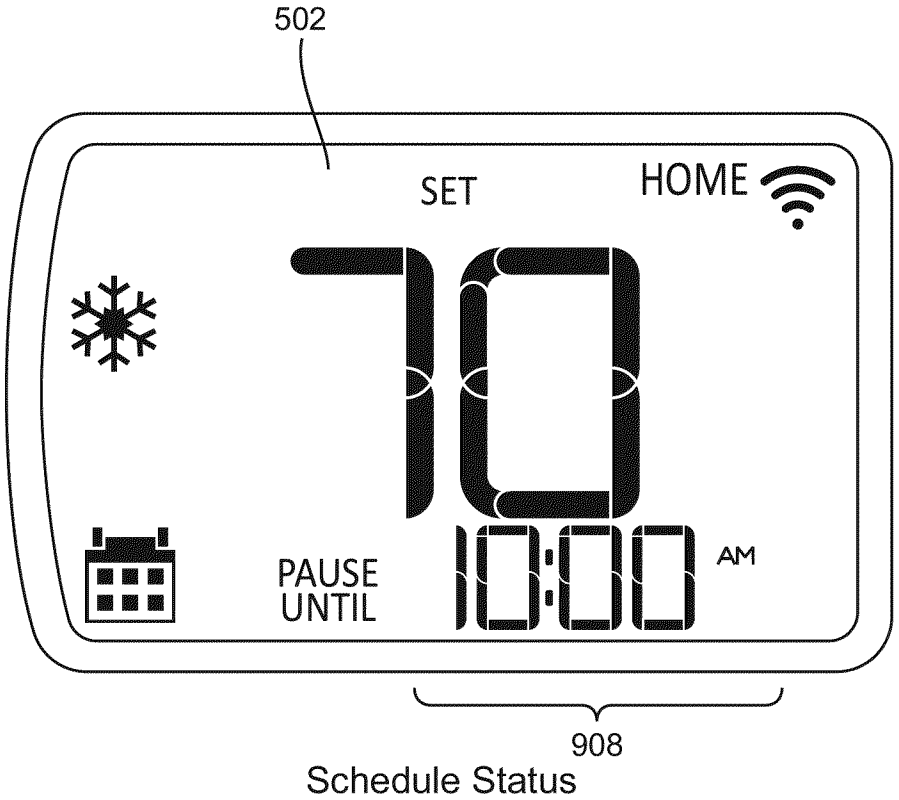
FIG. 10 is a front perspective view of a thermostat, which can be used in the system of FIG. 8B, according to some embodiments.
Figure 11:
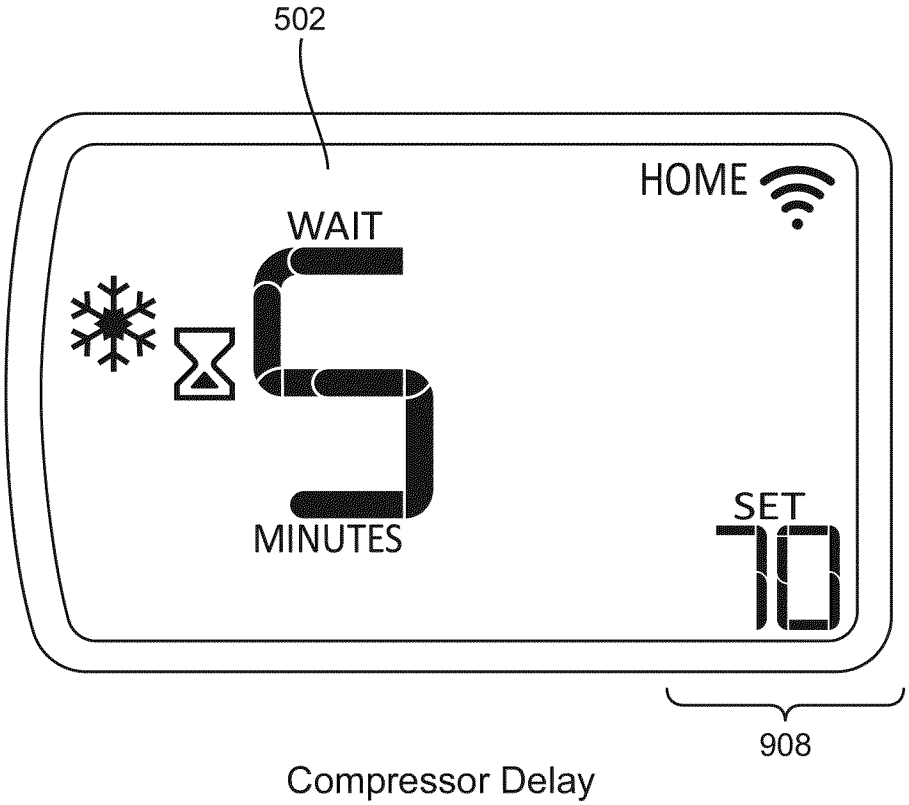
FIG. 11 is a front perspective view of a thermostat, which can be used in the system of FIG. 8B, according to some embodiments.

In various embodiments, segments 908 are used to indicate various numbers, settings, and operational modes on display 502, including temperature, setpoints, time, weather, fan enablement, warnings, or any combination thereof. For example, segments 908 display a time, as shown in FIG. 10. A user interacts with buttons 902-906 (as shown in FIG. 9A) to set the current time. In other embodiments, a user interacts with buttons 902-906 to set the temperature setpoint for thermostat 500, as shown in FIG. 11. In this embodiment, a user may select a temperature setting that is displayed using segments 908.

Figure 13:
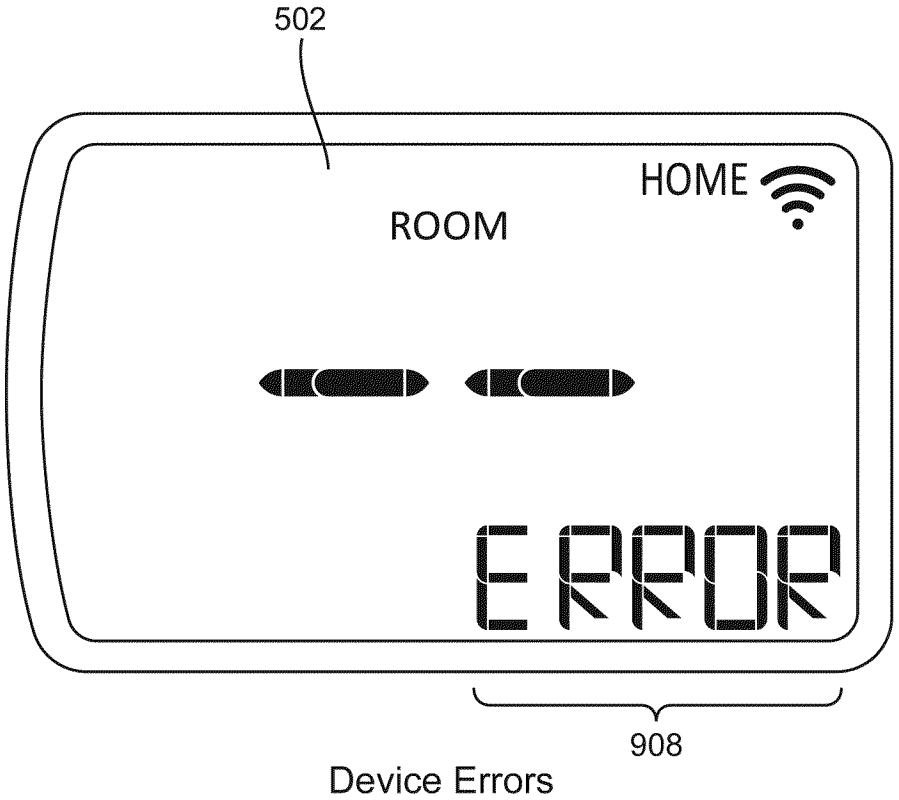
FIG. 13 is a front perspective view of a thermostat, which can be used in the system of FIG. 8B, according to some embodiments.

In other embodiments, a user interacts with buttons 902-906 (as shown in FIG. 13) to display an error message. As stated above, segments 908 may include more than 7 segments per character package to present a more detailed symbol, numeral, or character, such as a more detailed error message. For example, segments 908 in FIG. 13 illuminate the letter "R" three times in the word "ERROR". The letter "R" may not accurately be illuminated by a 7-segment character. Typical 7-segment characters (e.g., 7-seg character 909) include 6 segments around the perimeter of a formed rectangle (top, top-left, bottom-left, bottom, bottom-right, and top-right) and a horizontal segment in the center of the rectangle, making a rigid "8" shape. 7-seg packages may not typically include a diagonal segment that may be found in a package of a higher segment count, such as the diagonal segment required to display the leg of the letter "R."Accordingly, a display package greater than 7-segments, such as character 911, can be implemented in display 502 to illuminate the "ERROR" message as shown in FIG. 13. Various segment packages implemented within thermostat 500 may be include various segments, sizes, and types (e.g., LCD, LED, etc.).

In some embodiments, segment packages are implemented in various ways to illuminate different images on display 502 and are not limited to segments 908. For example, 7-seg packages may be implemented to illuminate "70" as shown in FIG. 10, which may represent the real-time temperature of a building zone from which thermostat 500 is receiving sensor data. The symbol, numeral, or character that is displayed from various sensor packages may vary, and includes but it not limited to: numerals, alphabet letters, words, symbols, icons, images, or any combination thereof.

In some embodiments, the segments may be illuminated in a manner that allows for animation to appear to occur. In some embodiments, the blink rate (e.g., ⅜ blink per second, ½blink per second, etc.) for illuminating different segments in display 502 is fast enough to provide the appearance of a constant animation. These animations may include a loading symbol. For example, character 120 may illuminate the outer segments in a constant circle when thermostat 500 is processing one or more actions (e.g., generating a control signal, analyzing a user input, etc.). The loading animation may also include illuminating the additional segments (e.g., segment 980) that may branch two characters together, thus providing a more complex animation. Any and all segments in display 502 may be illuminated in any order to provide an animation.

Removable Branding Insert

Figure 14:
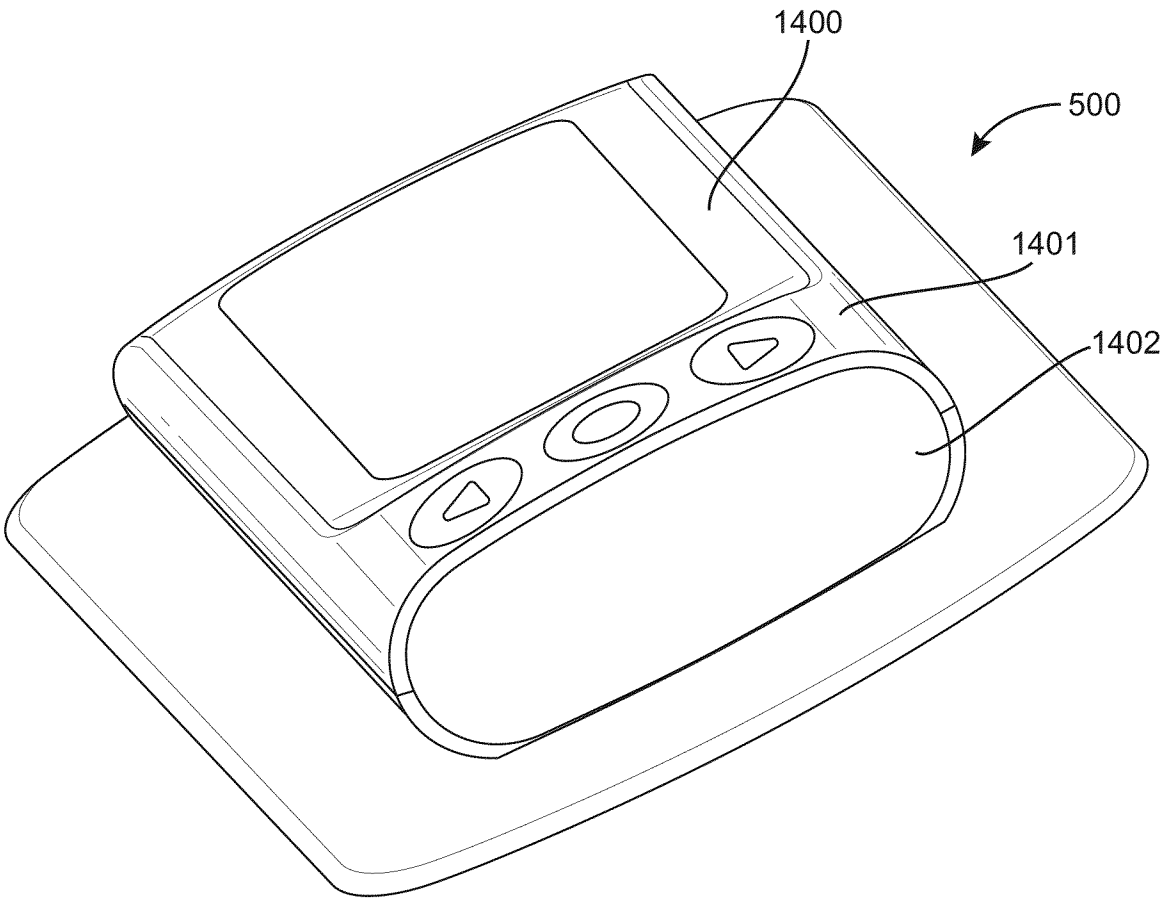
FIG. 14 is a front perspective view of a thermostat with a detachable component, which can be used in the system of FIG. 8B, according to some embodiments.

Referring now to FIG. 14, a perspective of thermostat 500 is shown, according to an exemplary embodiment. Thermostat 500 includes a housing 1400 including a main portion of the house or base 1401 and a removable portion or insert 1402. The removable insert 1402 is configured to be a removable component of thermostat 500. For example, a user may select one insert from a number of options and attach that insert to the base 1401. Different inserts display different branding or other identifiers on the outer surface of each segment so that when attached to the base 1401, the user or other observers of thermostat 500 are able to see the branding or other identifier provided by the selected insert 1402.

Removable insert 1402 may be attached to thermostat 500 by any form of mechanical coupling, including latching, fastening, sliding, or locking, or snap-fit connection. For example, a snap-fit or other connector on the segment 1402 base be received by a corresponding receptacle on the base and be used to attach the segment 1402 to the base 1401. In some embodiments, the connection between the segment 1402 and the base 1401 is a one-time connection such that the connection between the segment 1402 and the base 1401 can only be broken in a destructive manner. In other embodiments, removable insert 1402 magnetically couples to thermostat 500. Removable insert 1402 may be configured to couple and decouple in a simple and efficient way, such that a different component may be coupled to thermostat 500 in place of removable insert 1402. Thermostat 500 may have any part of its exterior configured to be removable and does not necessitate the bottom portion (i.e., removable insert 1402) to be configured to be removable. For example. A side portion of thermostat 500 may be configured to decouple from thermostat 500 in similar fashion to removable insert 1402.

Figure 15:
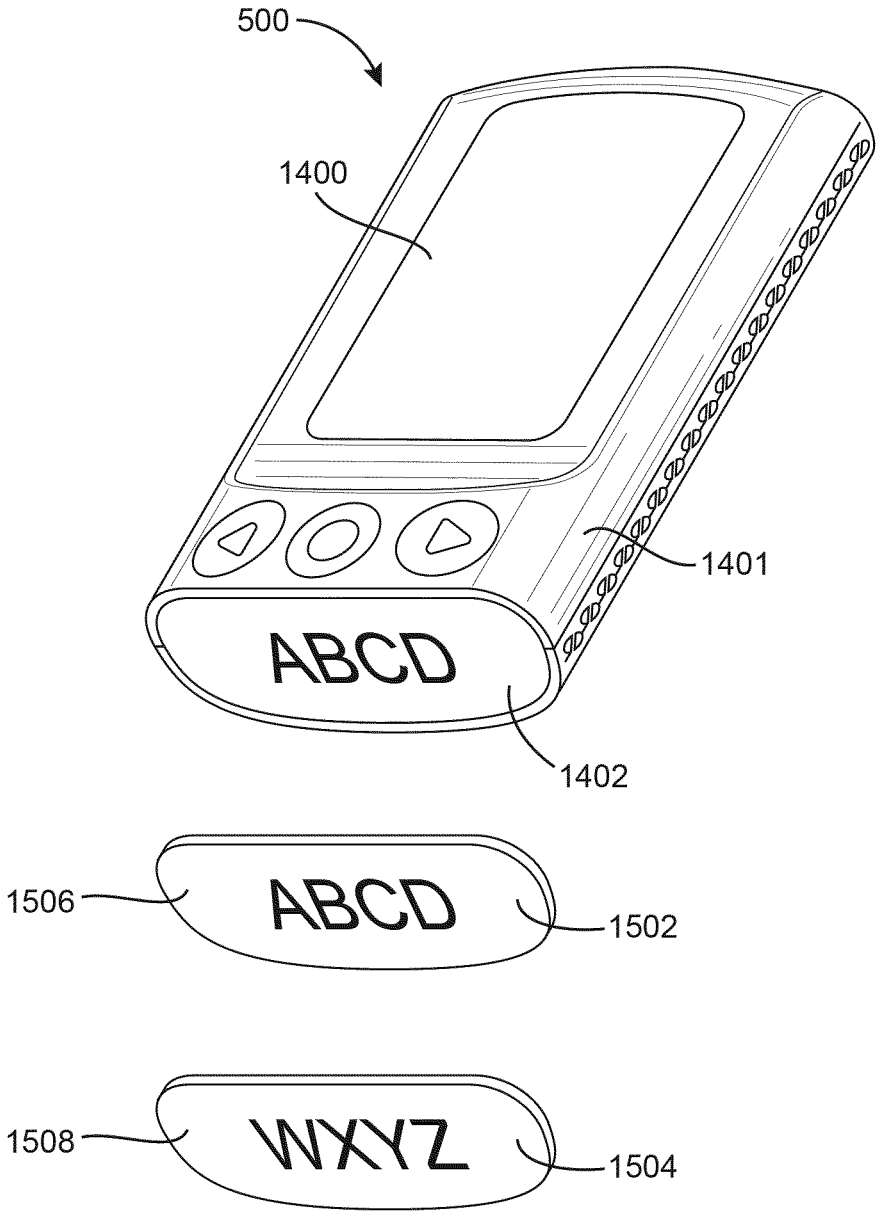
FIG. 15 is a front perspective view of a thermostat with a detachable component, which can be used in the system of FIG. 8B, according to some embodiments.

Referring now to FIG. 15, a perspective of thermostat 500 is shown, according to an exemplary embodiment. FIG. 15 shows first attachable component 1502 and second attachable component 1504. Attachable components 1502-1504 may be configured to couple to thermostat 500 in the identical or similar fashion as removable insert 1402 couples to thermostat 500. Attachable component 1502 is shown to include the brand 1506, which as illustrated reads "ABCD." Attachable components 1502-1504 may be indicative of the installer of the thermostat and may provide an indication to a view who or what business is responsible for the installment, procurement, or repair of the thermostat.

Brand 1506 be include any form of branding (e.g., marking, logo, etc.) and may be indicative of the company, person or persons, establishment, or business responsible for installing thermostat 500. For example, customer Jane orders thermostat 500 for her HVAC system at her residence. She contacts company ABCD to purchase thermostat 500 and requests that company ABCD install thermostat 500. Company ABCD installs the thermostat 500. Company ABCD then removes removable insert 1402 and replaces removable insert 1402 with attachable component 1502 that displays its brand "ABCD". Attachable component 1502 includes brand 1506, to indicate to Jane or other viewers the party responsible for installing thermostat 500.

In some embodiments, the brand may be indicative of the company, person or persons, establishment, or business responsible for designing thermostat 500. For example, Company WXYZ may manufacture and sell thermostat 500 to a supplier, such as Company ABCD. After thermostat 500 is installed in a residence, Company ABCD removes base plate 1402 and replaces removable insert 1402 with attachable component 1504. Attachable component 1504 includes brand 1508, to indicate to viewers the party responsible for manufacturing thermostat 500. In some embodiments, attachable component 1504 includes both the brand of the manufacturer and the brand of the installer.

In some embodiments, the removable insert 1402 includes locking mechanisms that allow attachable components 1502, 1504 to selectively couple to base plate 1402. These attachable components can include locking features, sliding features, magnetic locking features, fasteners, or any combination thereof. Removable insert 1402 and attachable components 1502,1504 may be configured such that removable insert 1402 may only mechanically couple to attachable components 1502,1504 or other attachable components that are identical or substantially similar in design.

In some embodiments, other identifiers may be provided on attachable components 1502, 1504 that allows thermostat 500 to make a communicable connection. For example, attachable components 1502, 1504 may include near-field communication devices, radio-frequency identification devices, transmitters, transceivers, and other components capable of making a communicable connection with thermostat 500. In some embodiments, thermostat 500 can detect when a particular attachable component has been coupled to thermostat 500. Then, thermostat 500 can provide information to display 502 based on the coupling and/or make control decisions based on the coupling.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A control device for a building, the control device comprising:

a segment display comprising:

a first character comprising at least seven segments;

a second character comprising at least nine segments proximate to the first character; and a connecting character comprising at least two segments located between the first character and the second character; and a processing circuit configured to:

in a first operation, illuminate at least one segment of each of the first character, the second character, and the connecting character to form a first letter; and in a second operation, illuminate at least one segment of each of the first character, the second character, and the connecting character to form a second letter.

2. The device of claim 1, wherein:

the control device is a thermostat, and illuminating at least one segment of each of the first character, the second character, and the connecting character to form the first letter further comprises illuminating the letter "M."

3. The device of claim 1, wherein illuminating at least one segment of each of the first character, the second character, and the connecting character to form the second letter further comprises illuminating the letter "W."

4. The device of claim 1, wherein illuminating at least one segment of each of the first character, the second character, and the connecting character to form the first letter further comprises:

illuminating a top segment of the first character;

illuminating a top segment of the second character;

illuminating a top segment of the connecting character; and illuminating a right segment on the first character or a left segment on the second character.

5. The device of claim 1, wherein illuminating at least one segment of each of the first character, the second character, and the connecting character to form the second letter further comprises:

illuminating a bottom segment of the first character;

illuminating a bottom segment of the second character;

illuminating a top segment of the connecting character; and illuminating a right segment on the first character or a left segment on the second character.

6. The device of claim 1, wherein the processing circuit is further configured to:

receive an error signal indicative of an error within the control device; and illuminate a plurality of characters to display an error message on the segment display;

wherein at least one of the plurality of characters includes at least nine segments; and wherein the error message comprises at least one letter "R."

7. The device of claim 1, wherein the connecting character comprising at least two segments located between the first character and the second character further comprises a first dot segment located above the bottom of the connecting character and a second dot segment located below the top of the connecting character, wherein illuminating the first dot segment and the second dot segment illuminates a colon symbol on a display of the device.

8. A method for displaying information on a control device, the method comprising:

displaying, via a segment display, a first character comprising at least seven segments;

displaying, via the segment display, a second character comprising at least nine segments proximate to the first character;

displaying, via the segment display, a connecting character comprising at least two segments located between the first character and the second character;

illuminating at least one segment of each of the first character, the second character, and the connecting character to form a first letter; and illuminating at least one segment of each of the first character, the second character, and the connecting character to form a second letter.

9. The method of claim 8, wherein illuminating at least one segment of each of the first character, the second character, and the connecting character to form the first letter further comprises illuminating the letter "M."

10. The method of claim 8, wherein illuminating at least one segment of each of the first character, the second character, and the connecting character to form the second letter further comprises illuminating the letter "W."

11. The method of claim 8, wherein illuminating at least one segment of each of the first character, the second character, and the connecting character to form the first letter further comprises:

illuminating a top segment of the first character;

illuminating a top segment of the second character;

illuminating a top segment of the connecting character; and illuminating a right segment on the first character or a left segment on the second character.

12. The method of claim 8, wherein illuminating at least one segment of each of the first character, the second character, and the connecting character to form the second letter further comprises:

illuminating a bottom segment of the first character;

illuminating a bottom segment of the second character;

illuminating a top segment of the connecting character; and illuminating a right segment on the first character or a left segment on the second character.

13. The method of claim 8, further comprising:

receiving an error signal indicative of an error within the control device; and illuminating a plurality of characters to display an error message on the segment display;

wherein at least one of the plurality of characters includes at least nine segments; and wherein the error message comprises at least one letter "R."

14. The method of claim 8, wherein the connecting character comprising at least two segments located between the first character and the second character further comprises a first dot segment located above the bottom of the connecting character and a second dot segment located below the top of the connecting character, wherein illuminating the first dot segment and the second dot segment illuminates a colon symbol on a display of the device.

15. A segment display screen for a thermostat comprising:

a first character comprising at least seven segments;

a second character comprising at least nine segments proximate to the first character; and a connecting character comprising at least two segments located between the first character and the second character; and wherein in a first operation, at least one segment of each of the first character, the second character, and the connecting character are illuminated to form a first letter; and wherein in a second operation, at least one segment of each of the first character, the second character, and the connecting character are illuminated to form a second letter.

16. The segment display screen of claim 15, wherein illuminating at least one segment of each of the first character, the second character, and the connecting character to form the first letter further comprises illuminating the letter "M."

17. The segment display screen of claim 15, wherein illuminating at least one segment of each of the first character, the second character, and the connecting character to form the first letter further comprises:

illuminating a top segment of the first character;

illuminating a top segment of the second character;

illuminating a top segment of the connecting character; and illuminating a right segment on the first character or a left segment on the second character.

18. The segment display screen of claim 15, wherein illuminating at least one segment of each of the first character, the second character, and the connecting character to form the second letter further comprises:

illuminating a bottom segment of the first character;

illuminating a bottom segment of the second character;

illuminating a top segment of the connecting character; and illuminating a right segment on the first character or a left segment on the second character.

19. The segment display screen of claim 15, wherein in a third operation, a plurality of characters are illuminated to display an error message on the segment display screen;

wherein at least one of the plurality of characters includes at least nine segments; and wherein the error message comprises at least one letter "R."

20. The segment display screen of claim 15, wherein the connecting character comprising at least two segments located between the first character and the second character further comprises a first dot segment located above the bottom of the connecting character and a second dot segment located below the top of the connecting character, wherein illuminating the first dot segment and the second dot segment illuminates a colon symbol on a display of the device.

* * * * *